US010365043B2

(12) United States Patent
Kakazu et al.

(10) Patent No.: US 10,365,043 B2
(45) Date of Patent: Jul. 30, 2019

(54) STIRRING FAN FOR HEAT TREATMENT APPARATUS, AND HEAT TREATMENT APPARATUS INCLUDING THE SAME

(71) Applicant: Koyo Thermo Systems Co., Ltd., Nara (JP)

(72) Inventors: Hiromi Kakazu, Tenri (JP); Norihide Fujiyama, Tenri (JP); Masanori Okumura, Tenri (JP); Takeshi Ueda, Tenri (JP)

(73) Assignee: Koyo Thermo Systems Co., Ltd., Nara (JP)

( * ) Notice: Subject to any disclaimer, the term of this patent is extended or adjusted under 35 U.S.C. 154(b) by 462 days.

(21) Appl. No.: 15/136,225

(22) Filed: Apr. 22, 2016

(65) Prior Publication Data

US 2016/0313064 A1 Oct. 27, 2016

(30) Foreign Application Priority Data

Apr. 24, 2015 (JP) ..... 2015-89303

(51) Int. Cl.

| | |
|---|---|
| ***F27D 7/04*** | (2006.01) |
| ***F27B 3/22*** | (2006.01) |
| ***F27B 7/36*** | (2006.01) |
| ***F27D 7/02*** | (2006.01) |

(52) U.S. Cl.

CPC ..... *F27D 7/04* (2013.01); *F27B 3/22* (2013.01); *F27B 7/36* (2013.01); *F27D 7/02* (2013.01); *F27D 2007/045* (2013.01)

(58) Field of Classification Search

CPC ..... F27D 7/04; F27D 2007/045; F27B 3/22; F27B 7/36; F27B 7/02

USPC ..... 416/181

See application file for complete search history.

(56) References Cited

U.S. PATENT DOCUMENTS 3,561,195 A * 2/1971 Bouru ..... B01D 45/14 415/180
3,850,574 A * 11/1974 Namba ..... C21D 1/767 432/19
4,150,919 A * 4/1979 Matucheski ..... F04D 29/329 416/169 A (Continued)

FOREIGN PATENT DOCUMENTS

CH 643153 A5 5/1984
JP S58-161628 U 10/1983

(Continued)

OTHER PUBLICATIONS

Notification of Reason for Refusal for corresponding JP application 2015-089303 and its English partial translation.

(Continued)

*Primary Examiner* — Timothy L Maust
(74) *Attorney, Agent, or Firm* — Studebaker & Brackett PC

(57) ABSTRACT

A shaft of a stirring fan for a heat treatment apparatus includes a blade fixing portion for fixing a plurality of blades. The blade fixing portion has a cylindrical portion extending in a shaft direction of the shaft. A hole inside the cylindrical portion is open to one end face of the shaft. The stirring fan has a discharge portion for discharging gas inside the cylindrical portion to the outside of the blade fixing portion. The discharge portion is open to the outside of the blade fixing portion, at a position away from the one end face of the shaft.

19 Claims, 11 Drawing Sheets

(56) References Cited

U.S. PATENT DOCUMENTS

2016/0313064 A1* 10/2016 Kakazu ..... F27D 7/04

FOREIGN PATENT DOCUMENTS

| | | | |
|---|---|---|---|
| JP | S61-250488 | A | 11/1986 |
| JP | 2001-321647 | A | 11/2001 |
| JP | 2014-037903 | A | 2/2014 |
| SU | 1679163 | A1 | 9/1991 |

OTHER PUBLICATIONS

An Office Action mailed by the State Intellectual Property Office of the People's Republic of China dated Oct. 17, 2018, which corresponds to Chinese Patent Application No. 201610190955.7 and is related to U.S. Appl. No. 15/136,225.

* cited by examiner

STIRRING FAN FOR HEAT TREATMENT APPARATUS, AND HEAT TREATMENT APPARATUS INCLUDING THE SAME

CROSS-REFERENCE TO RELATED APPLICATION

This application claims priority to Japanese Patent Application No. 2015-89303. The entire disclosure of Japanese Patent Application No. 2015-89303 is hereby incorporated herein by reference.

BACKGROUND OF THE INVENTION

1. Field of the Invention

The present invention relates to a stirring fan for a heat treatment apparatus, and a heat treatment apparatus including the same.

2. Description of Related Art

Fans as gas stirring members for heat treatment furnaces are known (see JP 2014-37903A for example). The fan described in JP 2014-37903A is used to stir gas at a high temperature such as about several hundreds of degrees.

This fan has a boss fixed to a rotational shaft, and a plurality of blades connected to an outer circumferential portion of the boss.

SUMMARY OF THE INVENTION

In order to acquire a sufficient amount of gas flow, it is necessary to rotate a fan at high speed. Accordingly, it is necessary to prevent the fan from being abnormally vibrated by this rotational movement at high speed. Thus, typically, the balance of the weight distribution in the fan is adjusted. Accordingly, abnormal vibration of the fan during rotation is prevented. Accordingly, the load that acts on the fan can be reduced, as a result of which the life of the fan can be prolonged.

Incidentally, there is a case in a heat treatment furnace that a treatment target article subject to room temperature is disposed near the fan previously set at a high temperature, and then the treatment target article is heated by a heater. In this case, the treatment target article is at a low temperature before being heated by the heater. Accordingly, the fan receives cool gas around the treatment target article. Accordingly, the surface temperature of the fan is suddenly lowered by the cool gas. On the other hand, the internal temperature of the fan is not suddenly lowered. As a result, the temperature gradient in the fan, especially the temperature gradient between the roots of the blades and the boss increases. Accordingly, large heat stress is generated at the blades of the fan. When heating of the treatment target articles are repeated, large heat stress repeatedly acts on the blades of the fan, and defects such as cracks occur in the fan. That is to say, the life of the fan ends at an early stage.

According to the configuration described in JP 2014-37903A, a hollow cylindrical portion is formed in the blade fixing portion. Accordingly, the heat capacity of the cylindrical portion at a portion thereof continuous with the roots of the blades has a value close to that of the heat capacity at the roots. Accordingly, for example, even when cool gas from a treatment target article that is to be subjected to heat treatment is brought into contact with the stirring fan at a high temperature, a difference between the temperature at the cylindrical portion and the temperature at the roots of the blades can be made smaller. That is to say, the temperature gradient between the cylindrical portion and the roots of the blades can be reduced. Thus, heat stress generated at the roots of the blades can be made smaller, as a result of which the life of the stirring fan can be prolonged.

Meanwhile, there is demand to further prolong the life of the stirring fan.

In view of these circumstances, it is an object of the present invention to prolong the life of a stirring fan for a heat treatment apparatus.

As a result of intense research, the inventors of the present invention have come to focus on a gas flow around a stirring fan when the stirring fan is rotationally driven. Specifically, when the stirring fan described in JP 2014-37903A is rotationally driven, gas flows from the center of the stirring fan outward in the radial direction of the stirring fan. However, since the cylindrical portion is formed in a dead-end shape, no gas flow is generated inside the cylindrical portion, and gas inside the cylindrical portion stays inside the cylindrical portion. Thus, heat exchange by convection flow is not facilitated inside the cylindrical portion.

On the other hand, a gas flow is brought into contact with the outer surface portion of the stirring fan when the stirring fan is rotationally driven. Thus, heat exchange by convection flow is actively facilitated. Accordingly, a temperature difference is generated between the portion around the cylindrical portion and the portion inside the cylindrical portion, and the temperature gradient between the cylindrical portion and the roots of the blades easily increases. Accordingly, heat stress is easily generated at the roots of the blades. The inventors of the present invention created the present invention based on the above-described findings.

(1) In order to solve the above-described problem, an aspect of the present invention is directed to a stirring fan for a heat treatment apparatus, including: a shaft; and a plurality of blades radially extending from the shaft, wherein the shaft includes a blade fixing portion for fixing the blades, the blade fixing portion includes a cylindrical portion extending in a shaft direction of the shaft, a hole inside the cylindrical portion is open to one end face of the shaft, the stirring fan further includes a discharge portion for discharging gas inside the cylindrical portion to the outside of the blade fixing portion, and the discharge portion is open to the outside of the blade fixing portion, at a position away from the one end face of the shaft.

With this configuration, a gas flow from the one end face side of the cylindrical portion toward the inside of the cylindrical portion can be brought into the cylindrical portion. The gas that entered the cylindrical portion from the one end face side of the cylindrical portion is discharged via the discharge portion to the outside of the blade fixing portion. If a gas flow is generated inside the cylindrical portion in this manner, heat exchange by convection flow is facilitated inside the cylindrical portion. As a result, the temperature difference between the inside of the cylindrical portion and the outer surface portion of the stirring fan can be suppressed. Thus, the temperature gradient between the cylindrical portion and the roots of the blades can be made smaller. That is to say, the heat stress generated at the roots of the blades can be made smaller. As a result, the load on the stirring fan is reduced, so that the life of the stirring fan can be prolonged.

(2) It is preferable that the discharge portion includes a discharge hole that is continuous with the hole inside the cylindrical portion and that is open to an outer surface of the stirring fan.

With this configuration, it is possible to generate a gas flow inside the cylindrical portion when rotationally driving the stirring fan, with a simple configuration in which a discharge hole connecting the space inside the cylindrical portion and the outside of the stirring fan is formed. Furthermore, since the discharge hole is formed, the mass of the stirring fan can be accordingly made smaller, and, thus, the weight of the stirring fan can be further reduced.

(3) It is more preferable that the discharge hole is open to an outer surface of the blade fixing portion.

With this configuration, it is possible to form a discharge hole with a simple configuration in which a through hole is formed through the blade fixing portion of the cylindrical portion.

(4) It is preferable that the discharge hole is disposed at a center portion of the blade fixing portion in the shaft direction of the shaft.

With this configuration, it is possible to acquire more solid portions at the boundary between the cylindrical portion and the portion other than the cylindrical portion, of the shaft, while sufficiently acquiring a gas flow inside the cylindrical portion. Thus, the strength of the shaft can be increased.

(5) It is preferable that when viewed in a central axis direction of the discharge hole, the discharge hole has circular-arc corners.

With this configuration, the shape of the discharge hole in the cylindrical portion becomes a smooth shape. As a result, it is possible to more reliably prevent stress from concentrating around the discharge hole.

(6) It is preferable that an inner circumferential face of the cylindrical portion includes a plurality of cylindrical faces that are arranged along the shaft direction, an inner diameter of a cylindrical face disposed on the deeper side of the cylindrical portion being smaller than an inner diameter of a cylindrical face disposed on the side of the one end face of the shaft, and the discharge hole is formed across at least two of the cylindrical faces.

With this configuration, while forming the cylindrical portion in the stirring fan, it is possible to provide a sufficient dimension of the shaft on the base end side opposite from the front end side of the cylindrical portion where the one end face is formed. Accordingly, it is possible to sufficiently acquire mutual connecting strengths at a portion connecting the blades and the blade fixing portion. Furthermore, it is possible to sufficiently acquire the size of the space inside the hole of the cylindrical portion. Accordingly, the amount of gas flow from the inside of the cylindrical portion to the outside can be further increased, and, thus, the effect of cooling down the cylindrical portion using the discharge hole can be further increased.

(7) It is preferable that one discharge hole is provided between two of the blades adjacent to each other in a circumferential direction of the shaft, and is disposed at a center portion between the two blades in the circumferential direction.

With this configuration, it is possible to form the discharge hole at a position relatively away from the roots of the blades, at which stress tends to be the highest when the stirring shaft is driven.

(8) It is preferable that a plurality of the discharge holes are provided between two of the blades adjacent to each other in a circumferential direction of the shaft.

With this configuration, it is possible to increase the total opening area of the discharge holes. Furthermore, it is possible to generate a gas flow more uniformly inside the cylindrical portion. Accordingly, the effect of cooling down the cylindrical portion using the discharge holes can be further increased.

(9) It is more preferable that the plurality of the discharge holes are provided along the shaft direction between the two blades.

With this configuration, it is possible to reliably generate a gas flow on the deeper side inside the cylindrical portion.

(10) It is more preferable that among the plurality of discharge holes, an opening area of a discharge hole that is closer to the one end face of the cylindrical portion than the others are is set to be smaller than an opening area of a discharge hole that is closer to a base end of the cylindrical portion than the others are.

With this configuration, it is possible to reduce a resisting force when a gas flows through the discharge hole on the deeper side inside the cylindrical portion. As a result, it is possible to more reliably generate a gas flow, even on the deeper side of the space inside the cylindrical portion at which it is relatively difficult to generate a gas flow. Accordingly, the gas flow distribution inside the cylindrical portion can be made more uniform. Thus, a bias in the temperature distribution (heat stress) in the cylindrical portion can be made smaller.

(11) It is preferable that the plurality of discharge holes are provided at an equal pitch along the circumferential direction of the shaft, between the two blades.

With this configuration, it is possible to generate a gas flow more uniformly inside the cylindrical portion, along the circumferential direction of the shaft.

(12) It is preferable that the discharge hole is formed in the shape of an elongated hole that is elongated in the shaft direction.

With this configuration, it is possible to reliably generate a gas flow over a wider range in the shaft direction, in the space inside the cylindrical portion.

(13) It is preferable that the stirring fan is made of heat-resistant steel, and a shape of the discharge hole is set such that $b/a \leq 0.7$ when the shaft and the blades of the stirring fan are rotationally driven in an atmosphere at 1000° C., where a tensile strength of the shaft and the blades is taken as "a", and stress at a point with the highest stress in the shaft and the blades is taken as "b".

With this configuration, it is possible to more reliably prevent damages such as cracks from occurring in the portion connecting the shaft and the blades (portion around the blade fixing portion), which is a point at which stress tends to be the highest in the stirring fan.

(14) It is preferable that $(B1 \times n1)/A1 \geq 0.1$, where an opening area of the inner circumferential face at one end in the shaft direction of the shaft is taken as A1, an opening area of the discharge hole in a cross-section orthogonal to an axial direction of the discharge hole is taken as B1, and the number of the discharge holes is taken as n1.

With this configuration, stress at the portion connecting the shaft and the blades (portion around the blade fixing portion), which is a point at which stress tends to be the highest in the stirring fan, can be made sufficiently small.

(15) It is preferable that $B21/A2 \geq 0.07$, where a total length of the blade fixing portion in the shaft direction is taken as A2, and a distance from the one end face of the cylindrical portion to the discharge hole is taken as B21.

With this configuration, stress at the portion connecting the shaft and the blades (portion around the blade fixing portion), which is a point at which stress tends to be the highest in the stirring fan, can be made sufficiently small. In particular, stress at the connecting portion on the one end face side of the cylindrical portion can be made sufficiently small.

(16) It is preferable that B22/A2≤0.5, where a total length of the blade fixing portion in the shaft direction is taken as A2, and a distance from another end opposite from the one end face, of the blade fixing portion, to the discharge hole is taken as B22.

With this configuration, stress at the portion connecting the shaft and the blades (portion around the blade fixing portion), which is a point at which stress tends to be the highest in the stirring fan, can be made sufficiently small. In particular, stress at the connecting portion on the other end side of the blade fixing portion can be made sufficiently small.

(17) It is preferable that B21/A2≥0.07, where a total length of the blade fixing portion in the shaft direction is taken as A2, and a distance from the one end face of the cylindrical portion to the discharge hole is taken as B21, and B22/A2≤0.5, where a distance from another end opposite from the one end face, of the blade fixing portion, to the discharge hole is taken as B22.

With this configuration, stress at the portion connecting the shaft and the blades (portion around the blade fixing portion), which is a point at which stress tends to be the highest in the stirring fan, can be made sufficiently small. In particular, stress at both the connecting portion on the one end face side of the cylindrical portion and the connecting portion on the other end side of the blade fixing portion can be made sufficiently small.

(18) It is more preferable that (B3×n3)/A3≥0.1, where a total length of an outer circumferential face of the cylindrical portion in a circumferential direction of the cylindrical portion is taken as A3, a length of the discharge hole in the circumferential direction is taken as B3, and the number of the discharge holes is taken as n3.

With this configuration, stress at the portion connecting the shaft and the blades (portion around the blade fixing portion), which is a point at which stress tends to be the highest in the stirring fan, can be made sufficiently small.

(19) In order to solve the above-described problem, an aspect of the present invention is directed to a heat treatment apparatus, including: a treatment chamber for performing heat treatment on a treatment target article; and the above-described stirring fan disposed in the treatment chamber.

With this configuration, the life of the stirring fan for a heat treatment apparatus can be prolonged.

It should be noted that the foregoing and other objects, features, and advantages of the present invention will become apparent upon reading the following description with reference to the accompanying drawings.

DETAILED DESCRIPTION OF THE INVENTION

Embodiments for carrying out the present invention will be described below with reference to the drawings. It should be noted that the present invention is broadly applicable to stirring fans for heat treatment apparatuses, and heat treatment apparatuses.

Outline of Thermal Treatment Apparatus

Figure 1:
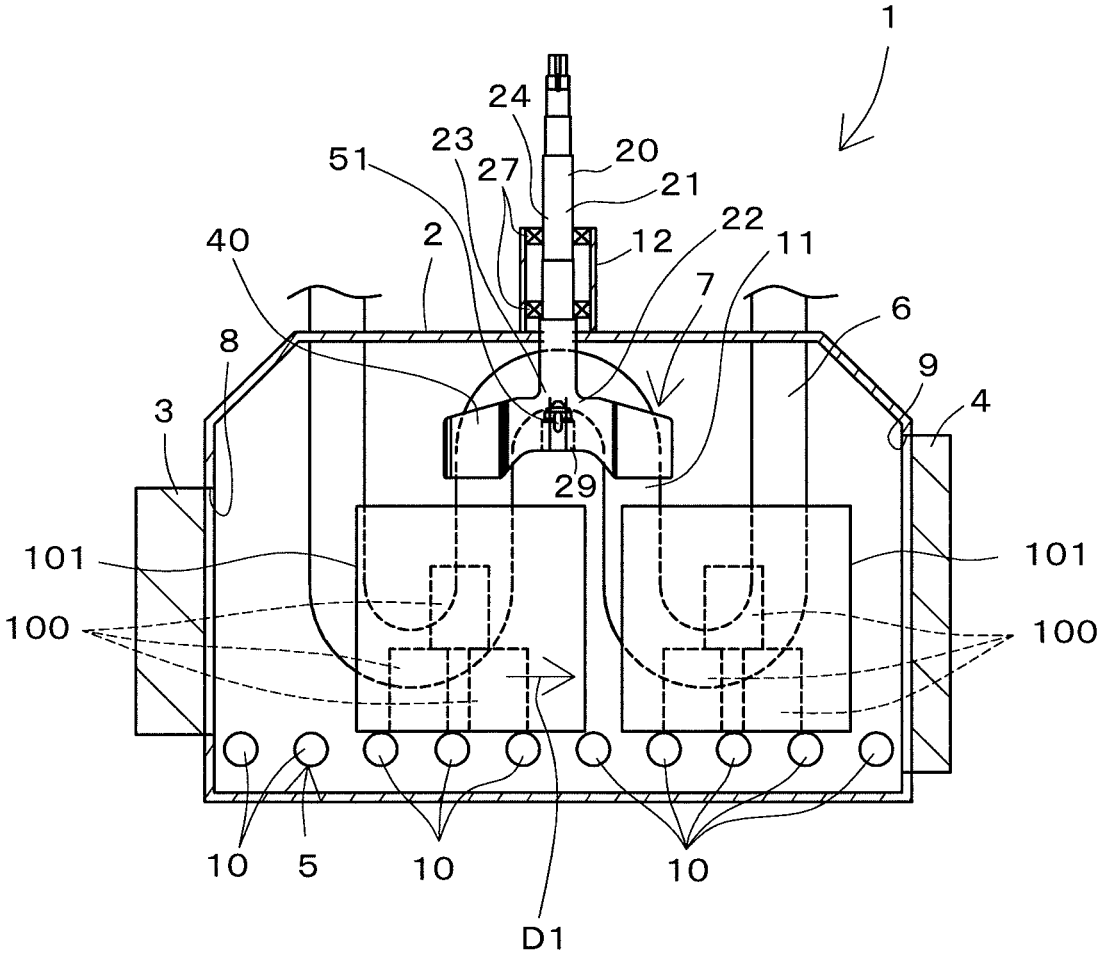
FIG. 1 is a partially cut-out schematic side view of a heat treatment apparatus according to an embodiment of the present invention.

FIG. 1 is a partially cut-out schematic side view of a heat treatment apparatus 1 according to an embodiment of the present invention. Referring to FIG. 1, the heat treatment apparatus 1 is provided in order to perform heat treatment on treatment target articles 100. Examples of the heat treatment include carburizing treatment, quenching treatment, tempering treatment, nitriding treatment, annealing treatment, and other types of heat treatment. In this embodiment, a description will be given using an example in which the heat treatment apparatus 1 is a gas carburizing treatment furnace. In this embodiment, the treatment target articles 100 are metal parts. The heat treatment apparatus 1 is configured to perform carburizing treatment on a plurality of treatment target articles 100 accommodated in containers 101.

Furthermore, the heat treatment apparatus 1 is provided as a batch-type heat treatment apparatus. Specifically, the heat treatment apparatus 1 accommodates a predetermined number of treatment target articles 100 as a batch to perform heat treatment on the treatment target articles 100. After the heat treatment, the treatment target articles 100 are ejected as a batch from the heat treatment apparatus 1.

The heat treatment apparatus 1 includes a treatment chamber 2, an inlet door 3, an outlet door 4, a conveyor device 5, a heater 6, and a stirring fan 7.

The treatment chamber 2 is formed in the shape of a box. The treatment chamber 2 is configured to accommodate the treatment target articles 100, and is configured to receive supply of gas for performing heat treatment on the treatment target articles 100. Examples of the gas include acetylene, ethylene, and the like. The treatment chamber 2 has an inlet 8 and an outlet 9.

The inlet 8 of the treatment chamber 2 can be opened and closed by the inlet door 3. The containers 101 accommodating the treatment target articles 100 are conveyed from the outside of the treatment chamber 2 via the inlet 8 to the inside of the treatment chamber 2. The outlet 9 of the treatment chamber 2 can be opened and closed by the outlet door 4. The containers 101 and the treatment target articles 100 in the treatment chamber 2 are conveyed from the inside of the treatment chamber 2 via the outlet 9 to the outside of the treatment chamber 2.

The inlet door 3 and the outlet door 4 are closed when heat treatment of the treatment target articles 100 is performed in the treatment chamber 2. The containers 101 and the treatment target articles 100 are conveyed inside the treatment chamber 2 by the conveyor device 5.

The conveyor device 5 has a plurality of rollers 10 as conveying members and support members. The plurality of rollers 10 are arranged between the inlet 8 and the outlet 9 inside the treatment chamber 2. The plurality of rollers 10 are arranged with an interval between the rollers 10 next to each other along a conveying direction D1, which is a direction from the inlet 8 toward the outlet 9. The containers 101 accommodating the treatment target articles 100 are conveyed in the conveying direction D1 on the plurality of rollers 10. The treatment target articles 100 are supported by the rollers 10 inside the treatment chamber 2, and the treatment target articles 100 are heated by the heater 6.

The heater 6 is, for example, a tube burner, and is configured to heat gas inside the treatment chamber 2. During heat treatment of the treatment target articles 100, the heater 6 heats gas inside the treatment chamber 2 to about 1000° C. The temperature is preferably about 800° C., and more preferably about 900° C.

In this embodiment, the heater 6 has a portion disposed inside the treatment chamber 2. This portion is disposed in a meandering manner, and meanders up and down along the conveying direction D1 inside the treatment chamber 2. In an intermediate region 11 between the inlet 8 and the outlet 9 in the conveying direction D1, the heater 6 is positioned in an upper portion in the treatment chamber 2. The stirring fan 7 is disposed adjacent to the intermediate region 11.

The stirring fan 7 is provided in order to stir gas inside the treatment chamber 2. The stirring fan 7 can promptly increase the temperature of the treatment target articles 100 in the treatment chamber 2. Furthermore, the stirring fan 7 can make the temperature distribution of gas inside the treatment chamber 2 more uniform.

The stirring fan 7 is disposed in an upper portion in the treatment chamber 2. The treatment target articles 100 are arranged below the stirring fan 7 when they are subjected to heat treatment. The stirring fan 7 is rotatably supported by the treatment chamber 2. The stirring fan 7 is rotated by a drive device such as an unshown electric motor. The stirring fan 7 is rotated by being driven by the drive device, thereby stirs gas inside the treatment chamber 2.

When performing heat treatment on the treatment target articles 100 in the heat treatment apparatus 1 having above described configuration, first, the inlet door 3 is opened. Next, the containers 101 accommodating the treatment target articles 100 are loaded from the inlet 8 into the treatment chamber 2. In this case, the containers 101 and the treatment target articles 100 have a temperature of, for example, room temperature such as about 20° C. The containers 101 and the treatment target articles 100 are conveyed in the conveying direction D1 by the conveyor device 5, and are arranged below the stirring fan 7.

Next, in a state where the inlet door 3 and the outlet door 4 are closed, heating by the heater 6 is started. Accordingly, gas inside the treatment chamber 2 is heated. Furthermore, the stirring fan 7 is rotated. Accordingly, the gas inside the treatment chamber 2 is stirred. Accordingly, the concentration distribution of the gas inside the treatment chamber 2 is made uniform, and the temperature of the gas inside the treatment chamber 2 is made uniform.

The temperature in the treatment chamber 2 is increased to the above-mentioned temperature. Accordingly, the treatment target articles 100 are subjected to heat treatment. After the heat treatment is completed, the outlet door 4 is opened. Furthermore, the conveyor device 5 operates. Accordingly, the containers 101 are ejected via the outlet 9 to the outside of the treatment chamber 2.

Detailed Configuration of Stirring Fan

Figure 2:
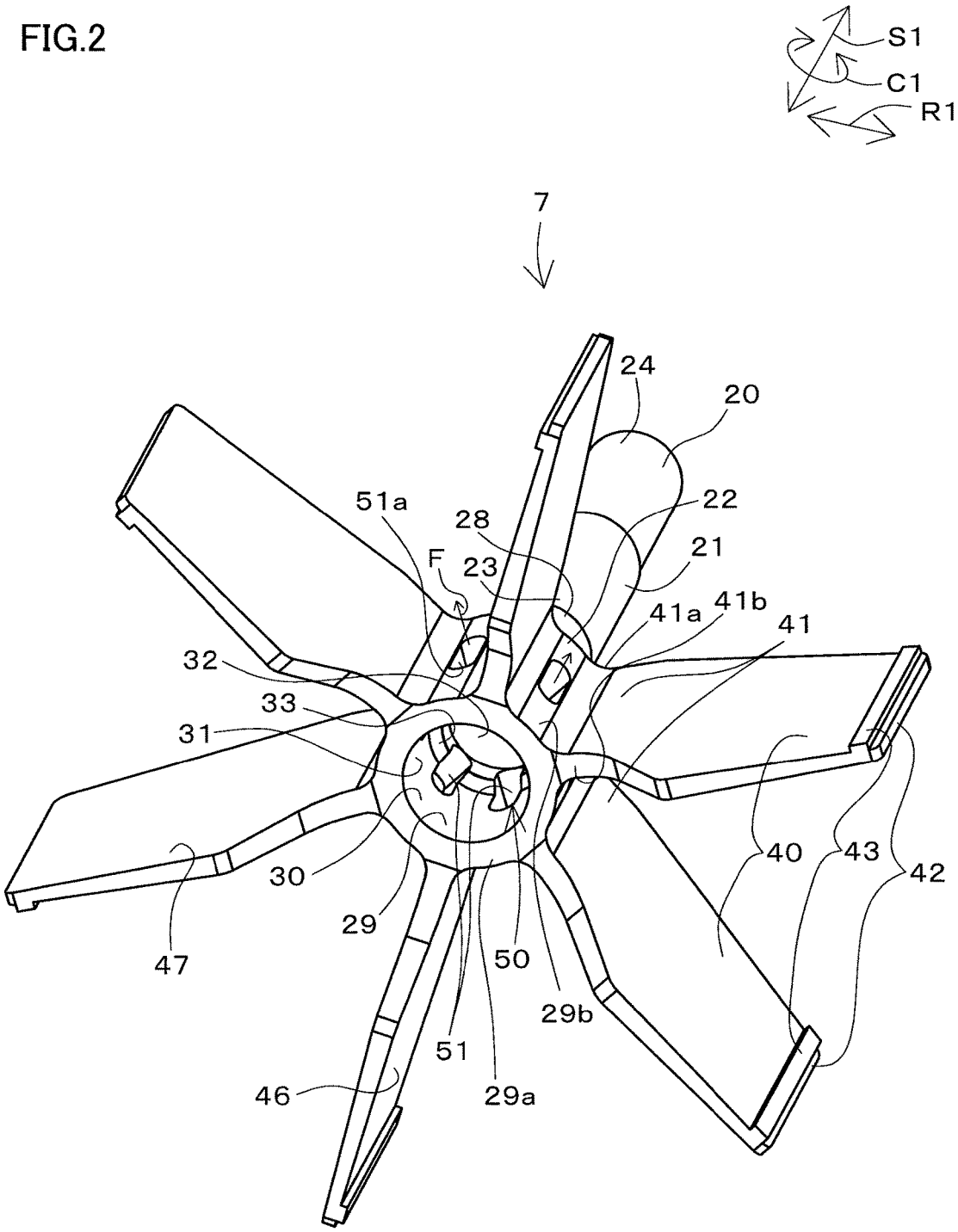
FIG. 2 is a perspective view of a main portion of a stirring fan.
Figure 3:
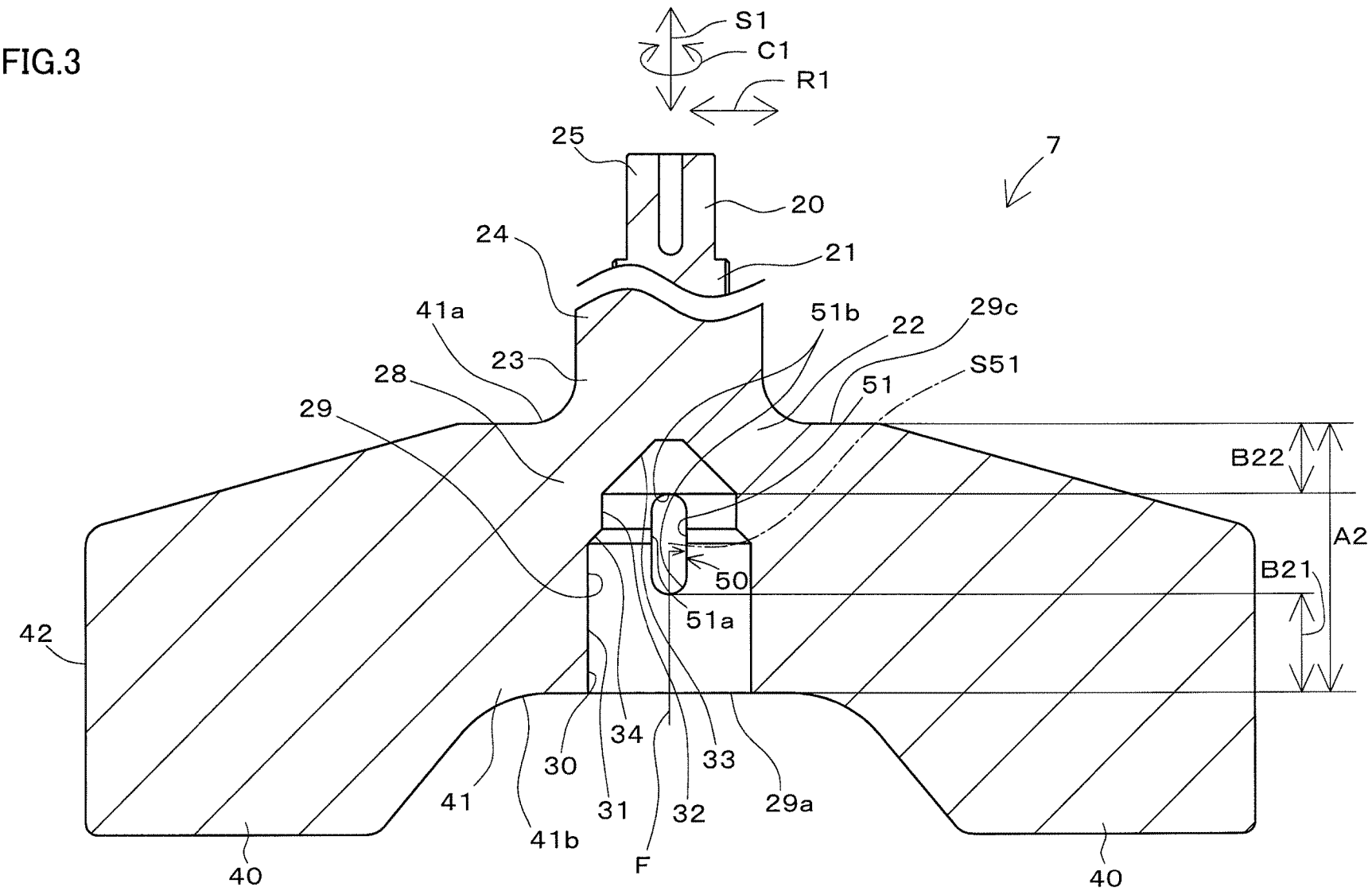
FIG. 3 is an enlarged cross-sectional view around a cylindrical portion of the stirring fan.
Figure 4:
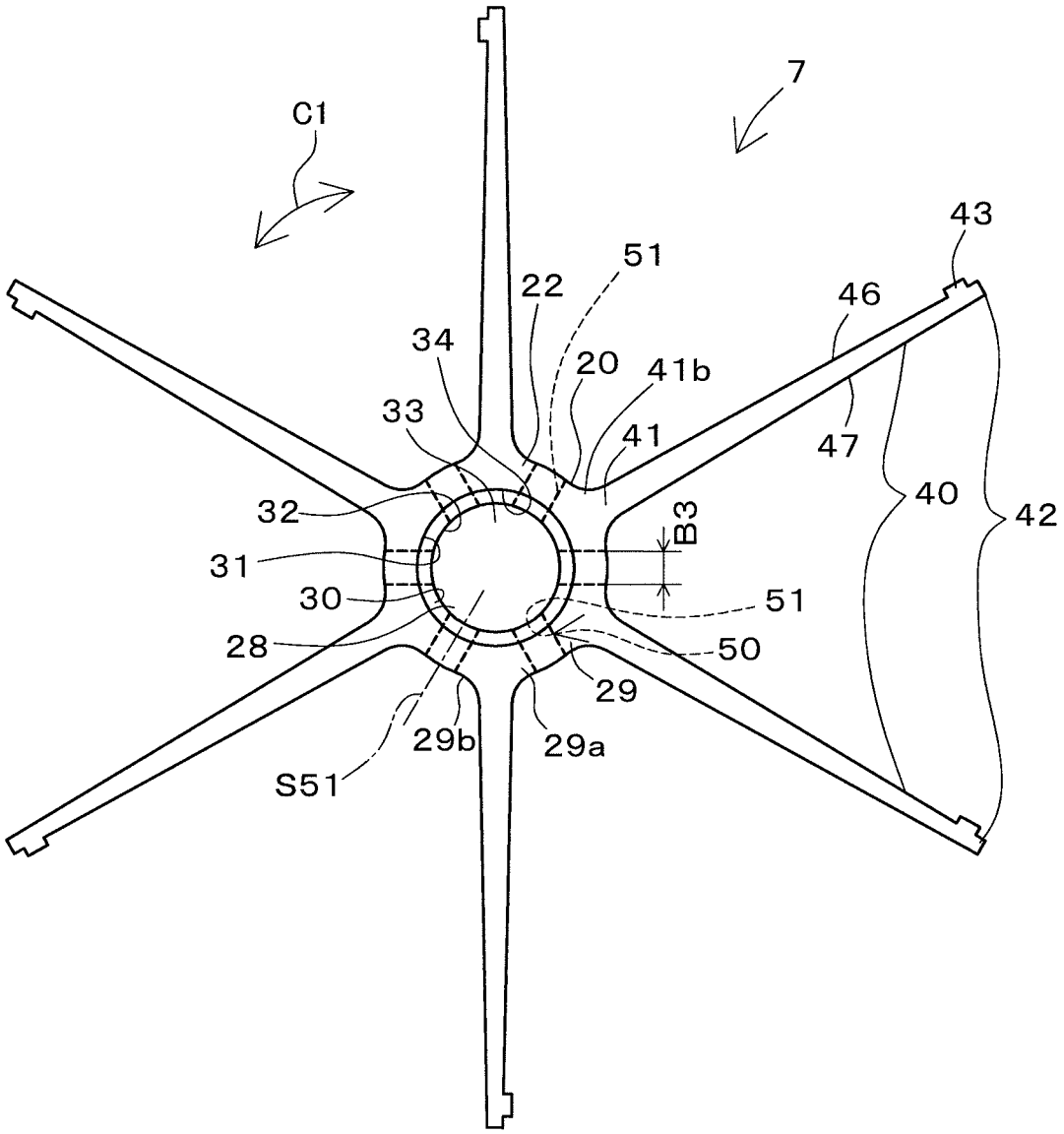
FIG. 4 is a bottom view of the stirring fan.

FIG. 2 is a perspective view of a main portion of the stirring fan 7. FIG. 3 is an enlarged cross-sectional view around a cylindrical portion of the stirring fan 7. FIG. 4 is a bottom view of the stirring fan 7.

Referring to FIGS. 2 to 4, in this embodiment, the stirring fan 7 is a centrifugal fan, and is configured to generate a gas flow outward in a radial direction R1 of the stirring fan 7. In the description below, a shaft direction S1 of the stirring fan 7 is simply referred to as a "shaft direction S1". In this embodiment, a direction that is parallel to the shaft direction S1 is also referred to as the shaft direction S1. Furthermore, the radial direction R1 of the stirring fan 7 is simply referred to as a "radial direction R1". Furthermore, a circumferential direction C1 of the stirring fan 7 is simply referred to as a "circumferential direction C1". In this embodiment, the shaft direction S1 is a vertical direction, and the radial direction R1 is a horizontal direction.

The stirring fan 7 is made of a metal material such as heat-resistant steel. Examples of the heat-resistant steel include SCH13, SCH22, SCH24, SCH31, and SCH46 as defined in JIS (Japanese Industrial Standards). There is no particular limitation on the method for producing the stirring fan 7. For example, the stirring fan 7 can be formed by pouring a molten metal material into a mold. More specifically, the stirring fan 7 can be formed by metal mold casting, lost wax process, or the like. In this embodiment, the stirring fan 7 is formed by metal mold casting.

The rotational speed of the stirring fan 7 is set to, for example, 100 rpm to 1600 rpm. If the rotational speed of the stirring fan 7 is equal to or higher than the above-mentioned lower limit, an amount of gas flow generated by the stirring fan 7 can be made sufficiently large. It is more preferable that the lower limit of the rotational speed of the stirring fan 7 is 500 rpm. If the rotational speed of the stirring fan 7 is equal to or lower than the above-mentioned upper limit, a centrifugal force of blades 40 (described later) of the stirring fan 7 is prevented from being excessively large. As a result, a tensile stress on the stirring fan 7 is prevented from being excessively large, and, thus, the life of the stirring fan 7 can be prolonged. The stirring fan 7 has been completed after being subjected to mass balance adjustment. Accordingly, vibration of the stirring fan 7 during rotation is prevented.

The stirring fan 7 has a shaft 20 substantially in the shape of a solid cylinder that is elongated in the shaft direction S1, a plurality of blades 40 radially extending from the shaft 20, and a discharge portion 50.

The shaft 20 has a main shaft portion 21 and a blade fixing portion 22.

The main shaft portion 21 is formed in the shape of a solid cylinder. That is to say, the main shaft portion 21 is provided as a solid cylinder member having no void space inside.

The main shaft portion 21 has one end portion 23, an intermediate portion 24, and another end portion 25. The other end portion 25, the intermediate portion 24, and the one end portion 23 are arranged in this order along the shaft direction S1.

The other end portion 25 constitutes the other end portion of the main shaft portion 21 in the shaft direction S1, and constitutes the other end portion of the stirring fan 7. The other end portion 25 is formed substantially in the shape of a cylinder. The other end portion 25 is configured such that a driving force from the unshown electric motor is input to the other end portion 25. The other end portion 25 is continuous with the intermediate portion 24.

The intermediate portion 24 is a portion in the shape of a solid cylinder that is elongated in the shaft direction S1, and is formed so as to have a shape whose diameter increases in a stepwise manner from the other end portion 25 toward the one end portion 23. The outer circumferential face of the intermediate portion 24 is fitted to bearings 27 (see FIG. 1). The bearings 27 are held by the treatment chamber 2.

Accordingly, the stirring fan 7 is rotatably supported via the bearings 27 by the treatment chamber 2. The rotational direction of the stirring fan 7 is one side in the circumferential direction C1. The intermediate portion 24 is continuous with the one end portion 23.

Referring again to FIGS. 2 to 4, the one end portion 23 is provided as a portion whose diameter continuously increases toward the blades 40. The one end portion 23 is continuous with the blade fixing portion 22.

The blade fixing portion 22 is provided in order to fix the plurality of blades 40. That is to say, the blade fixing portion 22 is provided as a portion connected to the blades 40. The blade fixing portion 22 forms the one end portion of the main shaft portion 21. In the shaft direction S1, the length of the blade fixing portion 22 is set to be shorter than that of the shaft 20.

The blade fixing portion 22 has a solid portion 28 and a cylindrical portion 29. The solid portion 28 and the cylindrical portion 29 are arranged in this order along the shaft direction S1.

The solid portion 28 is provided in order to acquire a sufficient connecting strength with respect to the blades 40. Specifically, the solid portion 28 is provided as a portion filled with metal material. That is to say, the solid portion 28 is provided as a portion in which no hole is formed. The solid portion 28 is continuous with the one end portion 23. The solid portion 28 is continuous with the cylindrical portion 29.

The cylindrical portion 29 is disposed so as to face the rollers 10 in the treatment chamber 2 (see FIG. 1). The distance between the containers 101 on the rollers 10 and the cylindrical portion 29 is, for example, about 10 cm to 20 cm in the vertical direction. The cylindrical portion 29 is provided as a hollow portion for reducing heat stress generated at the blades 40.

The cylindrical portion 29 has a hole 30 extending in the shaft direction S1 inside the cylindrical portion 29. The hole 30 is open at one end face 29*a* of the cylindrical portion 29, that is, one end face of the shaft 20, and extends along the shaft direction S1 from the one end face 29*a* toward the solid portion 28. Note that another end 29*c* (another end face) opposite from the one end face 29*a*, of the blade fixing portion 22, is continuous with the one end portion 23 of the main shaft portion 21. The hole 30 forms a substantially cylindrical space. The hole 30 is set such that its diameter decreases in a stepwise manner from the one end face 29*a* toward the deeper side of the hole 30. The other end portion of the hole 30 is formed so as to have a tapered shape, so that the diameter becomes smaller toward the solid portion 28.

The inner circumferential face of the hole 30 has a first cylindrical face 31, a second cylindrical face 32, and a tapered portion 33.

The first cylindrical face 31, the second cylindrical face 32, and the tapered portion 33 are sequentially arranged along the shaft direction S1. The first cylindrical face 31 and the second cylindrical face 32 are arranged such that the inner diameter sequentially decreases toward the deeper side of the cylindrical portion 29.

The first cylindrical face 31 is provided as a cylindrical portion continuous with the one end face 29*a*. In this embodiment, regarding the lengths in the shaft direction S1, the first cylindrical face 31 is the longest, the tapered portion 33 is the second longest, and the second cylindrical face 32 is the shortest. A chamfered portion 34 is formed at the boundary between the first cylindrical face 31 and the second cylindrical face 32, and the first cylindrical face 31 is connected via the chamfered portion 34 to the second cylindrical face 32.

The second cylindrical face 32 is disposed at a middle portion of the hole 30 in the shaft direction S1, and is disposed at a position deeper side of the cylindrical portion 29 with respect to a position of the first cylindrical face 31. The inner diameter of the second cylindrical face 32 is set to be smaller than that of the first cylindrical face 31. The second cylindrical face 32 is connected to the tapered portion 33.

The tapered portion 33 is formed so as to have a tapered shape whose diameter in a cross-section orthogonal to the shaft direction S1 decreases toward the deeper side of the hole 30. The bottom of the tapered portion 33 constitutes the deepest portion of the hole 30.

In this embodiment, the outer diameter of the cylindrical portion 29 is set to about 80 mm to 100 mm. The inner diameter of the cylindrical portion 29 (the diameter of the first cylindrical face 31) is set to about 50 mm to 70 mm. The thus configured blade fixing portion 22 fixes the plurality of blades 40.

In this embodiment, the blades 40 are provided in order to generate a gas flow outward in the radial direction R1. The plurality of blades 40 are provided with an equal interval (equal pitch) between the blades 40 next to each other along the circumferential direction C1, and radially extend from the blade fixing portion 22. In this embodiment, the number of blades 40 is six. These blades 40 have configurations that are the same as each other.

Each of the blades 40 is formed in the shape of a plate that extends along one direction in the radial direction R1 and extends along the shaft direction S1. The distance between the front end of the blade 40 and a central axis B1 of the stirring fan 7, that is, the radius of the stirring fan 7 is set to about 250 mm to 300 mm.

The thickness of the blade 40 is set to be largest at a root 41 of the blade 40. The thickness of the blade 40 is set to be smaller toward a front end portion 42 of the blade 40, and, in this embodiment, a protruding portion 43 is provided at the front end portion 42 of the blade 40.

The root 41 of the blade 40 is continuous with the blade fixing portion 22. One end portion 41*a* (upper portion) of the root 41 in the shaft direction S1 is fixed to the outer circumferential portion of the solid portion 28. Another end portion 41*b* (lower portion) of the root 41 in the shaft direction S1 is fixed to the outer circumferential portion of the cylindrical portion 29.

In the thus configured blade 40, heat stress at the root 41 is largest among the heat stress in the stirring fan 7. Especially during heat treatment by the heat treatment apparatus 1, stress (heat stress) generated in the stirring fan 7 tends to be largest at the one end portion 41*a* (upper portion) and the other end portion 41*b* (lower portion) of the root 41 of the blade 40. Thus, in this embodiment, the discharge portion 50 is provided as a configuration for reducing this stress.

The discharge portion 50 is provided in order to discharge gas inside the cylindrical portion 29 to the outside of the cylindrical portion 29 of the blade fixing portion 22. As indicated by the arrow F, gas enters the cylindrical portion 29 from the one end face 29*a* side of the cylindrical portion 29, passes through the discharge portion 50, and is discharged to the outside of the stirring fan 7. Accordingly, gas is prevented from staying inside the hole 30 of the cylindrical portion 29, and heat exchange by convection flow can be facilitated inside the cylindrical portion 29. As a result, the temperature difference between the outer circumference side and the inner circumference side of the cylindrical portion 29 is suppressed. Accordingly, the heat stress (bias in the heat) in the cylindrical portion 29 (the blade fixing portion 22) is suppressed. Hereinafter, the configuration of the discharge portion 50 will be more specifically described.

In this embodiment, the discharge portion 50 is formed in the cylindrical portion 29 of the blade fixing portion 22. More specifically, the discharge portion 50 has discharge holes 51.

Each of the discharge holes 51 is a through hole formed so as to extend through the cylindrical portion 29 in the radial direction R1. In this embodiment, the plurality of discharge holes 51 are formed with an equal pitch between the discharge holes 51 next to each other along the circumferential direction C1. More specifically, central axes S51 of the discharge holes 51 are arranged with an equal pitch (at a pitch of 60 degrees) between the central axes S51 next to each other along the circumferential direction C1, and the blades 40 and the discharge holes 51 are alternately arranged. Note that the discharge holes 51 have configurations that are the same as each other.

Each of the discharge holes 51 is open to the outside (outer surface) of the blade fixing portion 22, at a position away from the one end face 29*a* of the cylindrical portion 29 of the shaft 20. In this embodiment, the discharge hole 51 is open to the inner circumferential face of the hole 30 of the cylindrical portion 29, and is open to an outer circumferential face 29*b* of the cylindrical portion 29. In other words, the discharge hole 51 is continuous with the hole 30 in the cylindrical portion 29, and is open to the outer surface of the stirring fan 7.

In this embodiment, the central axis S51 of the discharge hole 51 is disposed at a center portion of the cylindrical portion 29 of the blade fixing portion 22 in the shaft direction S1. Note that the center of the discharge hole 51 may be disposed at the center portion of the cylindrical portion 29 in the shaft direction S1, or a point other than the center of the discharge hole 51 may be disposed at the center portion of the cylindrical portion 29. One discharge hole 51 is provided between two blades 40 adjacent to each other in the circumferential direction C1. The central axis S51 is disposed at the center between two blades 40 in the circumferential direction C1.

The discharge hole 51 is formed in the shape of an elongated hole that is elongated in the shaft direction S1. In this embodiment, the discharge hole 51 is formed across at least two cylindrical faces (the two cylindrical faces 31 and 32 in this embodiment) among the inner circumferential faces of the cylindrical portion 29. An inner circumferential face 51*a* of the discharge hole 51 is a smooth face extending along the radial direction R1. In other words, along the inner circumferential face 51*a* of the discharge hole 51 in the radial direction R1, the inner circumferential face 51*a* has no protrusions. Note that the inner circumferential face 51*a* of the discharge hole 51 may have protrusions or be inclined along the radial direction R1. If a chamfered portion or the like is formed at an end portion of the discharge hole 51 in the radial direction R1, the inner circumferential face 51*a* of the discharge hole 51 includes inclined portion.

When viewed in the central axis direction (the radial direction R1) of the discharge hole 51, the discharge hole 51 has circular-arc corners 51*b*. In this embodiment, the corners 51*b* are formed at both end portions of the discharge hole 51 in the shaft direction S1. When viewed in the central axis direction (the radial direction R1) of the discharge hole 51, each of the corners 51*b* is formed in the shape of a semicircle.

As described above, in this embodiment, the stirring fan 7 is made of heat-resistant steel. In this embodiment, when the shaft 20 and the blades 40 of the stirring fan 7 are rotationally driven in an atmosphere at 1000° C., a tensile strength of the shaft 20 and the blades 40 is defined as "a", and stress at a point with the highest stress in the shaft 20 and the blades 40 (in this embodiment, stress at the end portions 41*a* or the end portions 41*b* in the shaft direction S1 of the roots 41 as portions connecting the blade fixing portion 22 and the blades 40) is defined as "b". In this case, the shape of the discharge holes 51 is set such that $b/a \leq 0.7$.

Hereinafter, a specific example of a configuration for satisfying $b/a \leq 0.7$ with regard to the stress will be described. Examples of the configuration in this case include a configuration in which $(B1 \times n1)/A1 \geq 0.1$ is satisfied. In the formula, A1 is an opening area, in a cross-section orthogonal to the shaft direction S1, of the inner circumferential face of the hole 30 (the first cylindrical face 31) on the one end face 29*a* side of the shaft 20. Furthermore, B1 is an opening area of each of the discharge holes 51 in a cross-section orthogonal to an axial direction of the discharge holes 51 (the side face when viewed in the radial direction R1). Furthermore, n1 is the number of discharge holes 51 in the stirring fan 7. Note that if $(B1 \times n1)/A1 < 0.1$, the amount of gas flow for cooling down the cylindrical portion 29 from inside of the cylindrical portion 29 is not sufficient in the hole 30 of the cylindrical portion 29, and the heat stress resulting from the temperature difference between the outer surface and the inner portion of the cylindrical portion 29 is likely to become large.

Furthermore, examples of the configuration for satisfying $b/a \leq 0.7$ with regard to the stress include a configuration in which $B21/A2 \geq 0.07$ is satisfied. In the formula, A2 is a total length of the blade fixing portion 22 in the shaft direction S1. Furthermore, B21 is a distance from the one end face 29*a* of the cylindrical portion 29 to the discharge holes 51. Note that if $B21/A2 < 0.07$, it is difficult to generate a sufficient gas flow on the deeper side inside the cylindrical portion 29. As a result, the amount of gas flow for cooling down the cylindrical portion 29 from inside of the cylindrical portion 29 is not sufficient, and the heat stress resulting from the temperature difference between the outer surface and the inner portion of the cylindrical portion 29 is likely to become large.

Furthermore, examples of the configuration for satisfying $b/a \leq 0.7$ with regard to the stress include a configuration in which $B22/A2 \leq 0.5$ is satisfied. In the formula, B22 is a distance from the other end 29*c* opposite from the one end face 29*a*, of the blade fixing portion 22, to the discharge holes 51. Note that if $B22/A2 > 0.5$, it is difficult to generate a sufficient gas flow on the deeper side inside the cylindrical portion 29. As a result, the amount of gas flow for cooling down the cylindrical portion 29 from inside the cylindrical portion 29 is not sufficient, and the heat stress resulting from the temperature difference between the outer surface and the inner portion of the cylindrical portion 29 is likely to become large.

Furthermore, examples of the configuration for satisfying $b/a \leq 0.7$ with regard to the stress include a configuration in which $(B3 \times n3)/A3 \geq 0.1$ is satisfied. In the formula, A3 is a total length (circumferential length) of the outer circumferential face 29*b* of the cylindrical portion 29, in the circumferential direction C1 of the cylindrical portion 29. Furthermore, B3 is a length of each of the discharge holes 51 in the circumferential direction C1. Furthermore, n3 is the number of discharge holes 51 (n3=6, in this embodiment). Note that if (B3×n3)/A3<0.1, it is difficult to sufficiently acquire the amount of gas that can be discharged from the inside of the cylindrical portion 29 via the discharge holes 51. As a result, the amount of gas flow for cooling down the cylindrical portion 29 from inside of the cylindrical portion 29 is not sufficient, and the heat stress resulting from the temperature difference between the outer surface and the inner portion of the cylindrical portion 29 is likely to become large.

As described above, according to this embodiment, the discharge holes 51 of the discharge portion 50 are open to the outside of the blade fixing portion 22, at positions away from the one end face 29*a* of the shaft 20. With this configuration, a gas flow F from the one end face 29*a* side of the cylindrical portion 29 toward the inside of the cylindrical portion 29 can be brought into the cylindrical portion 29. The gas that entered the cylindrical portion 29 from the one end face 29*a* side of the cylindrical portion 29 is discharged via the discharge holes 51 of the discharge portion 50 to the outside of the blade fixing portion 22. If the gas flow F is generated inside the cylindrical portion 29 in this manner, heat exchange by convection flow is facilitated inside the cylindrical portion 29. As a result, the temperature difference between the inside of the cylindrical portion and the outer surface portion side of the stirring fan 7 can be suppressed. Thus, the temperature gradient between the cylindrical portion 29 and the roots 41 of the blades 40 can be made smaller. That is to say, the heat stress generated at the roots 41 of the blades 40 can be made smaller. As a result, the load on the stirring fan 7 is reduced, so that the life of the stirring fan 7 can be prolonged.

Furthermore, according to this embodiment, the discharge holes 51 are continuous with the hole 30 in the cylindrical portion 29, and are open to the outer surface of the stirring fan 7. According to this configuration, it is possible to generate the gas flow F inside the cylindrical portion 29 when rotationally driving the stirring fan 7, with a simple configuration in which the discharge holes 51 connecting the space inside the cylindrical portion 29 and the outside of the stirring fan 7 are formed. Furthermore, since the discharge holes 51 are formed, the mass of the stirring fan 7 can be accordingly made smaller, and, thus, the weight of the stirring fan 7 can be further reduced.

Furthermore, according to this embodiment, the discharge holes 51 are open to the outer surface of the blade fixing portion 22. According to this configuration, it is possible to form the discharge holes 51 with a simple configuration in which through holes are formed through the cylindrical portion 29 of the blade fixing portion 22.

Furthermore, according to this embodiment, each of the discharge holes 51 is disposed at a center portion of the blade fixing portion 22 in the shaft direction S1 of the shaft 20. With this configuration, it is possible to acquire more solid portions at the boundary between the cylindrical portion 29 and the portion other than the cylindrical portion 29, of the shaft 20, while sufficiently acquiring the gas flow F inside the cylindrical portion 29. Thus, the strength of the shaft 20 can be increased.

Furthermore, according to this embodiment, when viewed in the central axis direction of each discharge hole 51, the discharge hole 51 has the circular-arc corners 51*b*. With this configuration, the shape of the discharge hole 51 in the cylindrical portion 29 becomes a smooth shape. As a result, it is possible to more reliably prevent stress from concentrating around the discharge holes 51.

Furthermore, according to this embodiment, the plurality of cylindrical faces 31 and 32 having different inner diameters are formed in the cylindrical portion 29. Accordingly, while forming the cylindrical portion 29 in the stirring fan 7, it is possible to provide a sufficient dimension of the shaft 20 on the base end side opposite from the front end side of the cylindrical portion 29 where the one end face 29*a* is formed. Accordingly, it is possible to sufficiently acquire mutual connecting strengths at a portion connecting the blades 40 and the blade fixing portion 22. Furthermore, it is possible to sufficiently provide the size of the space inside the hole 30 of the cylindrical portion 29. Accordingly, the amount of the gas flow F from the inside of the cylindrical portion 29 to the outside can be further increased, and, thus, the effect of cooling down the cylindrical portion 29 using the discharge holes 51 can be further increased.

Furthermore, according to this embodiment, one discharge hole 51 is provided between two blades 40 adjacent to each other in the circumferential direction C1, and is disposed at a center portion between the two blades 40 in the circumferential direction C1. With this configuration, it is possible to form the discharge holes 51 at positions relatively away from the roots 41 of the blades 40, at which stress tends to be the highest when the stirring fan 7 is driven.

Furthermore, according to this embodiment, each of the discharge holes 51 is formed in the shape of an elongated hole that is elongated in the shaft direction S1. With this configuration, it is possible to allow the discharge holes 51 to reliably generate the gas flow F over a wider range in the shaft direction S1 in the space inside the cylindrical portion 29.

Furthermore, according to this embodiment, the shape of the discharge holes 51 is set such that b/a≤0.7. With this configuration, it is possible to more reliably prevent damages such as cracks from occurring in the portion connecting the shaft 20 and the blades 40 (portion around the blade fixing portion 22), which is a point at which stress tends to be the highest in the stirring fan 7.

Furthermore, according to this embodiment, settings are performed such that (B1×n1)/A1≥0.1. With this configuration, stress at the portion connecting the shaft 20 and the blades 40 (portion around the blade fixing portion 22), which is a point at which stress tends to be the highest in the stirring fan 7, can be made sufficiently small.

Furthermore, according to this embodiment, settings are performed such that B21/A2≥0.07. With this configuration, stress at the portion connecting the shaft 20 and the blades 40 (portion around the blade fixing portion 22), which is a point at which stress tends to be the highest in the stirring fan 7, can be made sufficiently small. In particular, stress at the connecting portion on the one end face 29*a* side of the cylindrical portion 29 can be made sufficiently small.

Furthermore, according to this embodiment, settings are performed such that B22/A2≤0.5. With this configuration, stress at the portion connecting the shaft 20 and the blades 40 (portion around the blade fixing portion 22), which is a point at which stress tends to be the highest in the stirring fan 7, can be made sufficiently small. In particular, stress at the connecting portion on the other end 29*c* side of the blade fixing portion 22 can be made sufficiently small.

Furthermore, according to this embodiment, both the condition that B21/A2≥0.07 and the condition that B22/A2≤0.5 are satisfied. With this configuration, stress at the portion connecting the shaft 20 and the blades 40 (portion around the blade fixing portion 22), which is a point at which stress tends to be the highest in the stirring fan 7, can be made sufficiently small. In particular, stress at both the connecting portion on the one end face 29*a* side of the cylindrical portion 29 and the connecting portion on the other end 29*c* side of the blade fixing portion 22 can be made sufficiently small.

Furthermore, according to this embodiment, settings are performed such that (B3×n3)/A3≥0.1. With this configuration, stress at the portion connecting the shaft 20 and the blades 40 (portion around the blade fixing portion 22), which is a point at which stress tends to be the highest in the stirring fan 7, can be made sufficiently small.

Although an embodiment of the present invention has been described above, it will be appreciated that all modifications, applications and equivalents thereof that fall within the appended claims whose modifications and applications become apparent upon reading and understanding the present specification are intended to be embraced within the scope of the invention. For example, the following changes may be made to the invention.

Figure 5:
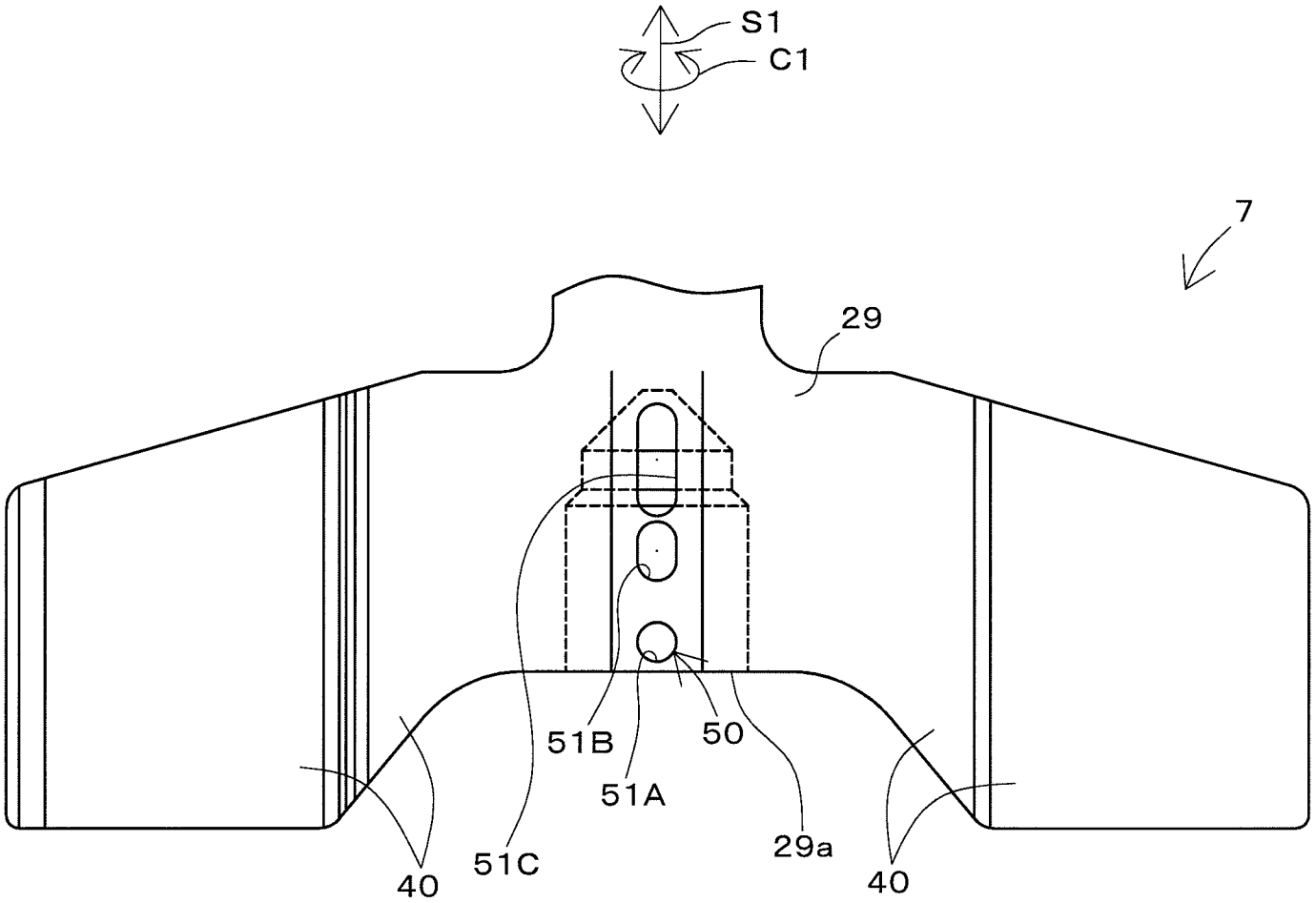
FIG. 5 is a side view of a main portion showing a modified example in which a plurality of discharge holes arranged along a shaft direction are formed between two blades.

(1) For example, in the foregoing embodiment, a description was given using an example in which one discharge hole 51 is formed between the blades 40. However, there is no limitation to this. For example, as shown in the modified example in FIG. 5, the cylindrical portion 29 may be provided with two or more discharge holes 51A, 51B, and 51C between the two blades 40 adjacent to each other in the circumferential direction C1.

The discharge holes 51A, 51B, and 51C are a plurality of discharge holes provided along the shaft direction S1 in the cylindrical portion 29, between two blades 40 adjacent to each other in the circumferential direction C1. The discharge holes 51A, 51B, and 51C are provided, for example, between each pair of blades 40 on the cylindrical portion 29. The discharge holes 51A, 51B, and 51C are sequentially arranged from the one end face 29*a* side of the cylindrical portion 29 along the shaft direction S1.

Each of the discharge holes 51A 51B, and 51C is formed, for example, in the shape of an elongated hole that is elongated in the shaft direction S1. In this embodiment, among the discharge holes 51A 51B, and 51C, the opening area of the discharge hole 51A that is closer to the one end face 29*a* of the cylindrical portion 29 than the others are is set to be smaller than that of the discharge hole 51C that is closer to a base end of the cylindrical portion 29 than the others are. In this embodiment, settings can be made such that the opening area of the discharge hole 51A<the opening area of the discharge hole 51B<the opening area of the discharge hole 51C. Note that it is also possible that the opening area of the discharge hole 51A=the opening area of the discharge hole 51B=the opening area of the discharge hole 51C, or the order of the sizes of the opening areas may be the inverse of that described above.

With the above-described configuration, since gas is sucked from the lower side (the one end face 29*a* side) of the cylindrical portion 29, the pressure on the upper side (inner side) inside the cylindrical portion 29 becomes high. Thus, if the discharge holes 51A 51B, and 51C have the same size, the velocity of gas discharged from the discharge hole 51C on the upper side increases, as a result, the temperature at the edge portion of the discharge hole 51C increases. Thus, the discharge hole 51C on the upper side is formed so as to have a larger size, so that the velocity is made smaller. The velocities of gas from the discharge holes 51A 51B, and 51C are more preferably made equal to each other, so that the edge portions of the discharge holes 51A 51B, and 51C have the same heat transfer coefficient.

In this embodiment, the lengths (widths) of the discharge holes 51A, 51B, and 51C in the circumferential direction C1 are the same, but they may be different. Furthermore, regarding the lengths of the discharge holes 51A, 51B, and 51C in the shaft direction S1, the discharge hole 51A is the shortest, the discharge hole 51B is the second shortest, and the discharge hole 51C is the longest.

According to this modified example, the cylindrical portion 29 is provided with the discharge holes 51A, 51B, and 51C that are a plurality of discharge holes, between the blades 40. With this configuration, it is possible to increase the total opening area of the discharge holes 51A, 51B, and 51C. Furthermore, it is possible to generate the gas flow F more uniformly inside the cylindrical portion 29. Accordingly, the effect of cooling down the cylindrical portion 29 using the discharge holes 51A 51B, and 51C can be further increased.

Furthermore, according to this modified example, the plurality of discharge holes 51A 51B, and 51C are provided along the shaft direction S1 between two blades 40. With this configuration, it is possible to reliably generate a gas flow on the deeper side inside the cylindrical portion 29.

Furthermore, according to this modified example, the plurality of discharge holes 51A 51B, and 51C are set such that the opening area of the discharge hole 51A that is closer to the one end face 29*a* of the cylindrical portion 29 than the others are is smaller than that of the discharge hole 51C that is closer to a base end of the cylindrical portion 29 than the others are. With this configuration, it is possible to reduce a resisting force when a gas flows through the discharge hole 51C on the deeper side inside the cylindrical portion 29. As a result, it is possible to more reliably generate the gas flow F, even on the deeper side of the space inside the cylindrical portion 29 at which it is relatively difficult to generate a gas flow F. Accordingly, the gas flow distribution inside the cylindrical portion 29 can be made more uniform. Thus, a bias in the temperature distribution (heat stress) in the cylindrical portion 29 can be made smaller.

Figure 6:
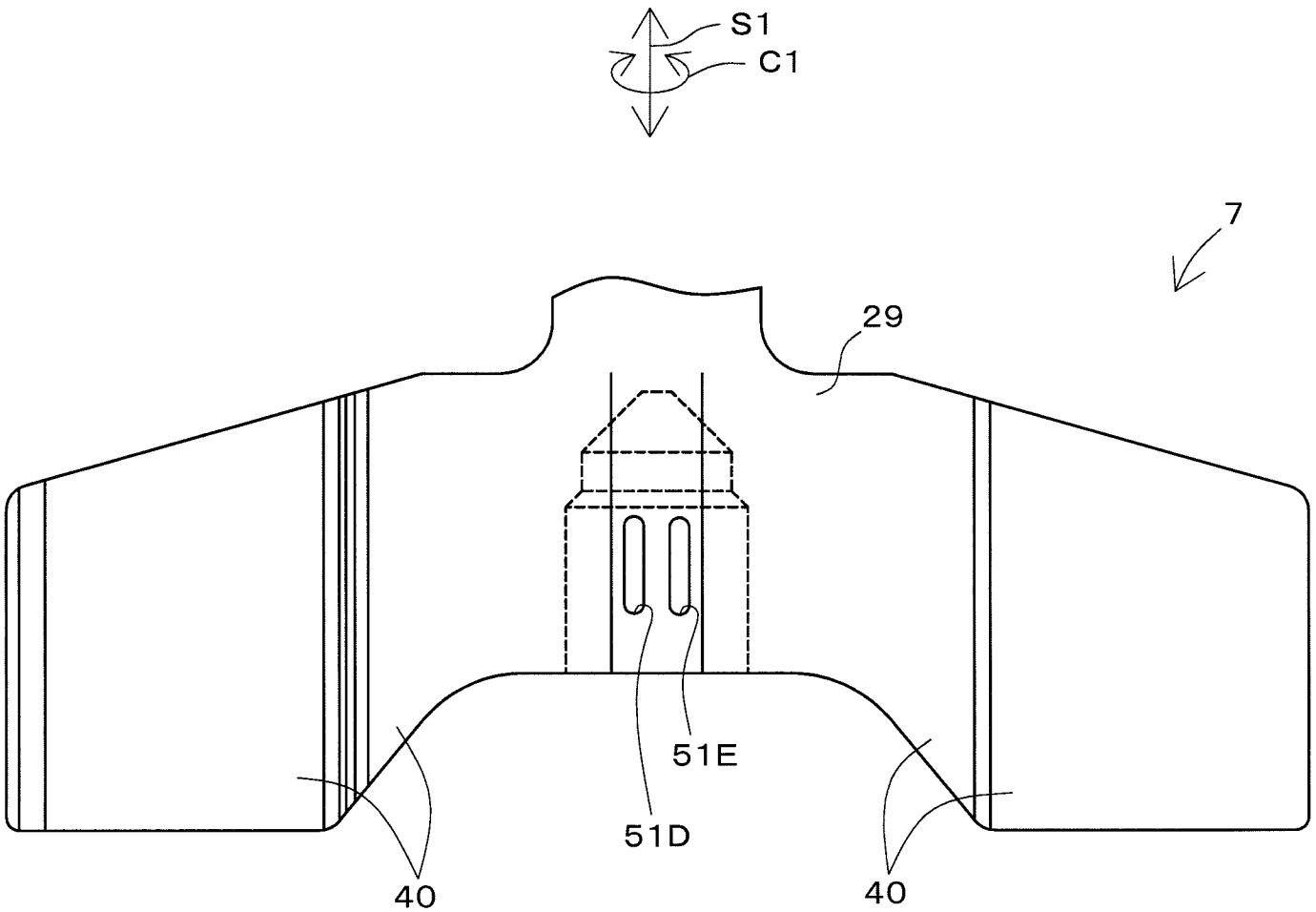
FIG. 6 is a side view of a main portion showing a modified example in which a plurality of discharge holes arranged along a circumferential direction are formed between two blades.

(2) In the foregoing embodiment, the plurality of discharge holes 51A, 51B, and 51C are arranged along the shaft direction S1 between the blades 40. However, there is no limitation to this. For example, as shown in FIG. 6, a plurality of discharge holes 51D and 51E may be arranged along the circumferential direction C1, between two blades 40 adjacent to each other in the circumferential direction C1. The discharge holes 51D and 51E have, for example, a shape that is substantially the same as that of the discharge holes 51. The discharge holes 51D and 51E are arranged with an equal pitch between the discharge holes 51D and 51E next to each other along the circumferential direction C1 between two blades 40. That is to say, the center of the blade 40, the center of the discharge hole 51D, the center of the discharge hole 51E, and the center of the blade 40, arranged along the circumferential direction C1, are arranged with an equal interval between the centers next to each other along the circumferential direction C1. Note that the intervals need not be equal.

In this modified example, the discharge holes 51D and 51E are provided with an equal pitch between the discharge holes 51D and 51E next to each other along the circumferential direction C1 between two blades. With this configuration, it is possible to generate the gas flow F more uniformly inside the cylindrical portion 29, along the circumferential direction C1.

Figure 7:
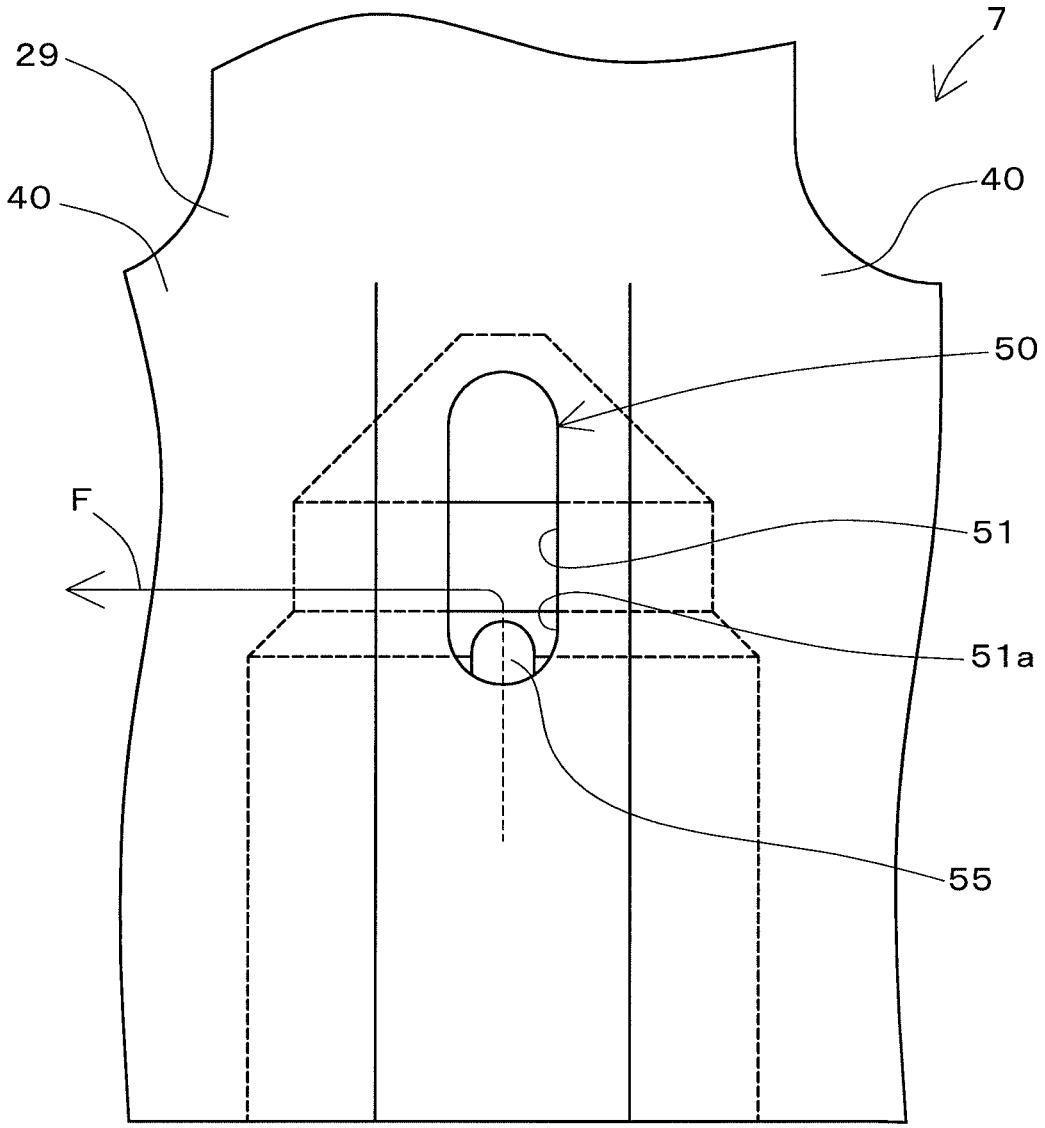
FIG. 7 is a side view of a main portion showing a modified example in which a flow regulating portion is formed at a discharge hole.

(3) In the foregoing embodiment and modified examples, the inner circumferential faces 51*a* of the discharge holes 51 are smooth faces. However, there is no limitation to this. For example, as shown in FIG. 7, the inner circumferential faces 51*a* of the discharge holes 51 may be provided with a flow regulating portion 55. The flow regulating portion 55 is provided in order to regulate a gas flow from the inside of the cylindrical portion 29 to the outside of the cylindrical portion 29. The flow regulating portion 55 is formed as a fin projecting from the inner circumferential face 51*a* of the discharge hole 51. Note that the flow regulating portion 55 may have a shape recessed from the inner circumferential face 51*a* of the discharge portion 50.

If the thus configured flow regulating portion 55 is provided, the amount of gas discharged from the inside of the cylindrical portion 29 to the outside of the cylindrical portion 29 can be further increased.

Furthermore, in the foregoing embodiment and modified examples, a description was given using an example in which a discharge hole extending through the cylindrical portion 29 in the radial direction R1 is formed as the discharge portion 50. However, there is no limitation to this. The discharge portion may have any configuration as long as it is open to the inside of the cylindrical portion 29, and is open to the outside of the blade fixing portion 22, at a position away from the one end face 29*a* of the shaft 20. For example, a discharge hole extending through the shaft 20 in the shaft direction S1 may be formed.

EXAMPLES

In the examples below, a description will be given regarding a case in which the shape of the discharge holes is set such that b/a≤0.7 when the shaft and the blades of the stirring fan are rotationally driven in an atmosphere at 1000° C., where a tensile strength of the shaft and the blades is taken as "a", and stress at a point with the highest stress in the shaft and the blades is taken as "b".

1. Description of Significance of Performing Setting such that (B1×n1)/A1≥0.1, where Opening Area of Inner Circumferential Face of Cylindrical Portion at One End in Shaft Direction of Shaft is Taken as A1, Opening Area of Discharge Hole in Cross-Section Orthogonal to Axial Direction of Discharge Hole is Taken as B1, and Number of Discharge Holes is Taken as n1

Production of Examples

Examples 1 to 5 were produced by performing a computer simulation of stirring fans having the same shape as that of the stirring fan 7 shown in FIG. 2 of the foregoing embodiment. Note that settings were made such that the materials used in Examples 1 to 5 were SCH13 as defined in JIS (Japanese Industrial Standards), and the tensile strength "a" at 1000° C. was 88 MPa. In Examples 1 to 5, (B1×n1)/A1 was as follows.

Example 1: (B1×n1)/A1=0.1
Example 2: (B1×n1)/A1=0.5
Example 3: (B1×n1)/A1=1.0
Example 4: (B1×n1)/A1=1.5
Example 5: (B1×n1)/A1=2.0

Production of Comparative Example

A comparative example was produced by performing a computer simulation of a stirring fan having the same configuration as that in Examples above, except that no discharge hole was formed. That is to say, the comparative example had no discharge hole, and (B1×n1)/A1=0.

Experimental Conditions

Regarding the examples, a computer simulation using the finite element method was performed under the conditions below.

Conditions: In a state where a stirring fan set to stand at an orientation in which the blades were positioned on the lower side was heated to 1000° C., the stirring fan was rotated at a predetermined rotational speed (1000 rpm). The stress at both end portions (the upper portion and the lower portion) in the shaft direction of the root of a blade at that time was calculated. Both end portions in the shaft direction of the root of the blade are points with the highest stress when the stirring fan is driven. Note that the stress in the examples is von Mises stress.

The stress ratios (b/a) were shown in a graph, where a tensile strength (88 MPa) of the stirring fan at 1000° C. was taken as "a", and stress at each of both end portions in the shaft direction of the root of the blade was taken as "b". In the following graphs, lines indicating trends in the results of comparative examples and examples are also shown.

Also regarding the comparative example, the stress at both end portions in the shaft direction of the root of the blade in the comparative example was calculated under the above-described conditions, and the stress ratio (b/a) was shown in a graph.

Calculation Results

Figure 8:
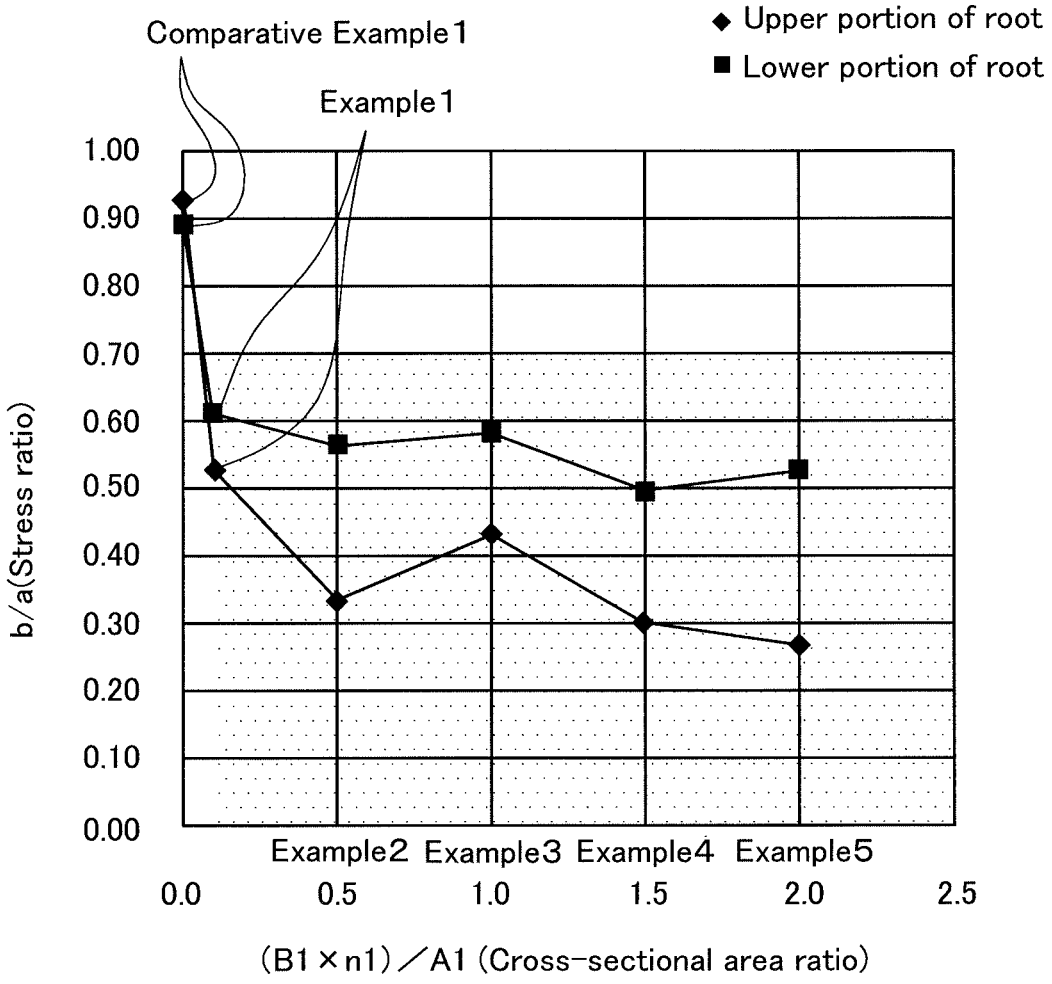
FIG. 8 is a graph showing test results.

FIG. 8 shows the results. Referring to FIG. 8, in the comparative example, the stress ratio (b/a) was significantly larger than 0.7 at both the upper portion and the lower portion of the root of the blade. Accordingly, it is shown that the load that acted on the root of the blade was large, which is not preferable for realizing a longer life of the stirring fan.

On the other hand, in Examples 1 to 5, the stress ratios (b/a) had small values lower than 0.7 at both the upper portion and the lower portion of the root of the blade. Accordingly, it is shown that the load that acted on the root of the blade was small, which is preferable for realizing a longer life of the stirring fan. Note that the difference between the stress ratios (b/a) of Comparative Example 1 and Example 1 was more drastic than that between Example 1 and Example 2. Thus, the critical significance of performing setting such that (B1×n1)/A1≥0.1 is clear.

Furthermore, in Examples 1 to 5, although the values of (B1×n1)/A1 varied significantly, the difference between the stress ratios (b/a) was as small as about 0.3. Thus, if (B1×n1)/A1≥0.1, no apparent difference was seen in the stress ratio (b/a). Accordingly, it is proven that if (B1×n1)/A1≥0.1, the stress ratio in the stirring fan can be made sufficiently small, and more specifically, the stress ratio b/a≤0.7 can be realized.

2. Description of Significance of Performing Setting such that B22/A2≤0.5, where Total Length of Blade Fixing Portion in Shaft Direction is Taken as A2, and Distance from Another End Opposite from One End Face, of Blade Fixing Portion, to Discharge Hole is Taken as B22

Production of Examples

Examples 6, 7, 8, and 9 were produced by performing a computer simulation of stirring fans having the same shape as that of the stirring fan 7 shown in FIG. 2 of the foregoing embodiment. Note that the materials used in Examples 6 to 9 were the same as those in Example 1. In Examples 6 to 9, B22/A2 was as follows.

Example 6: (B22/A2)=0.26
Example 7: (B22/A2)=0.33
Example 8: (B22/A2)=0.38
Example 9: (B22/A2)=0.50

Production of Comparative Examples

Comparative Examples 2 and 3 were produced by performing a computer simulation of stirring fans having the same configuration as that in Examples 6 to 9. In Comparative Examples 2 and 3, B22/A2 was as follows.

Comparative Example 2: (B22/A2)=0.55

Comparative Example 3: (B22/A2)=0.60

Experimental Conditions

The experimental conditions in Examples 6 to 9 and Comparative Examples 2 and 3 were the same as those in Examples 1 to 5. In Examples 6 to 9 and Comparative Examples 2 and 3, the stress ratio (b/a) at the upper portion of the root of the blade was shown in a graph.

Calculation Results

Figure 9:
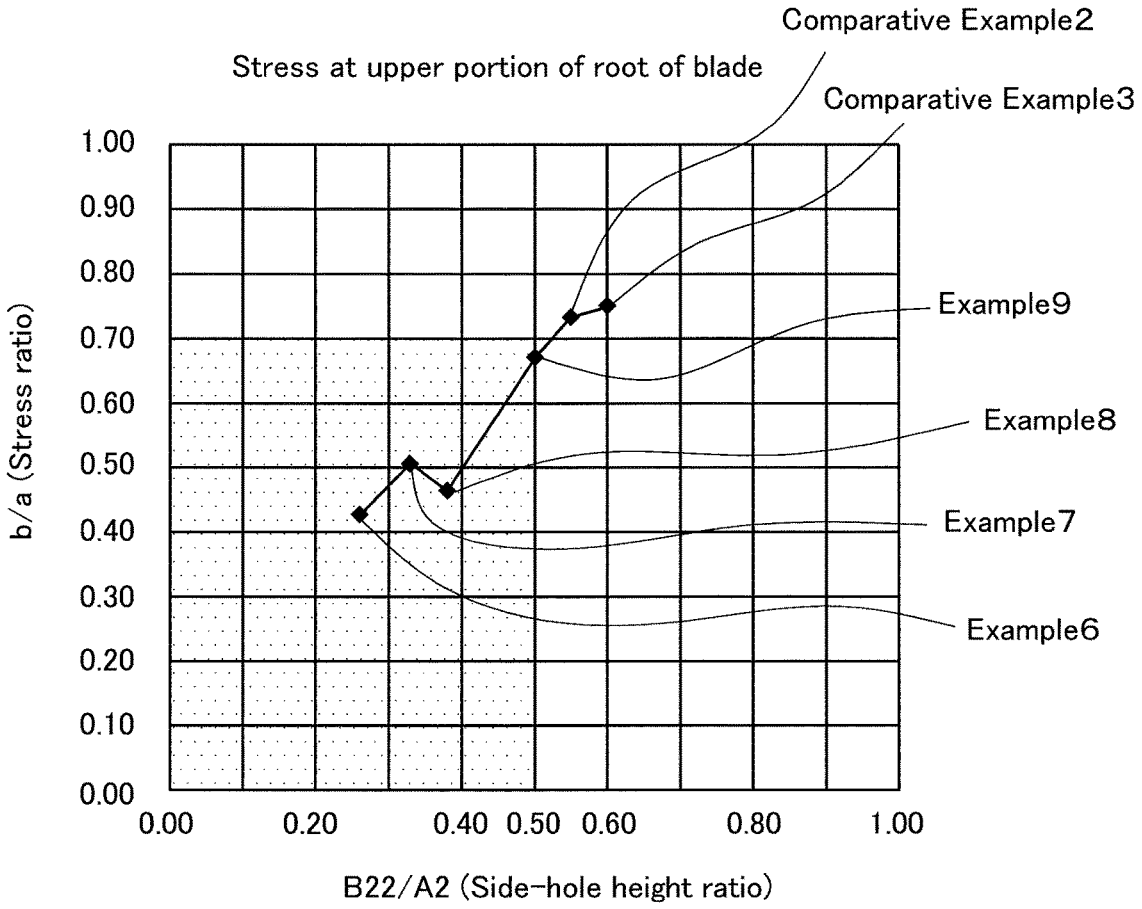
FIG. 9 is a graph showing test results.

FIG. 9 shows the results. Referring to FIG. 9, in Comparative Examples 2 and 3, as described above, the stress ratios (b/a) were significantly larger than 0.7 at the upper portion of the root of the blade. Accordingly, it is shown that the load that acted on the root of the blade was large, which is not preferable for realizing a longer life of the stirring fan.

On the other hand, in Examples 6 to 9, the stress ratios (b/a) had small values lower than 0.7 at the upper portion of the root of the blade. Accordingly, it is shown that the load that acted on the root of the blade was small, which is preferable for realizing a longer life of the stirring fan. Thus, the critical significance of performing setting such that (B22/A2)≤0.5 is clear.

3. Description of Significance of Performing Setting such that B21/A2≥0.07, where Total Length of Blade Fixing Portion in Shaft Direction is Taken as A2, and Distance from One End Face of Cylindrical Portion to Discharge Hole is Taken as B21

Production of Examples

Examples 10 to 14 were produced by performing a computer simulation of stirring fans having the same shape as that of the stirring fan 7 shown in FIG. 2 of the foregoing embodiment. Note that the materials used in Examples 10 to 14 were the same as those in Example 1. In Examples 10 to 14, B21/A2 was as follows.

Example 10: (B21/A2)=0.07

Example 11: (B21/A2)=0.12

Example 12: (B21/A2)=0.24

Example 13: (B21/A2)=0.30

Example 14: (B21/A2)=0.38

Production of Comparative Examples

Comparative Example 4 was produced by performing a computer simulation of a stirring fan having the same configuration as that in Examples 10 to 14. In Comparative Example 4, B21/A2 was as follows.

Comparative Example 4: (B21/A2)=0.03

Experimental Conditions

The experimental conditions in Examples 10 to 14 and Comparative Example 4 were the same as those in Examples 1 to 5. In Examples 10 to 14 and Comparative Example 4, the stress ratios (b/a) were shown in a graph.

Figure 10:
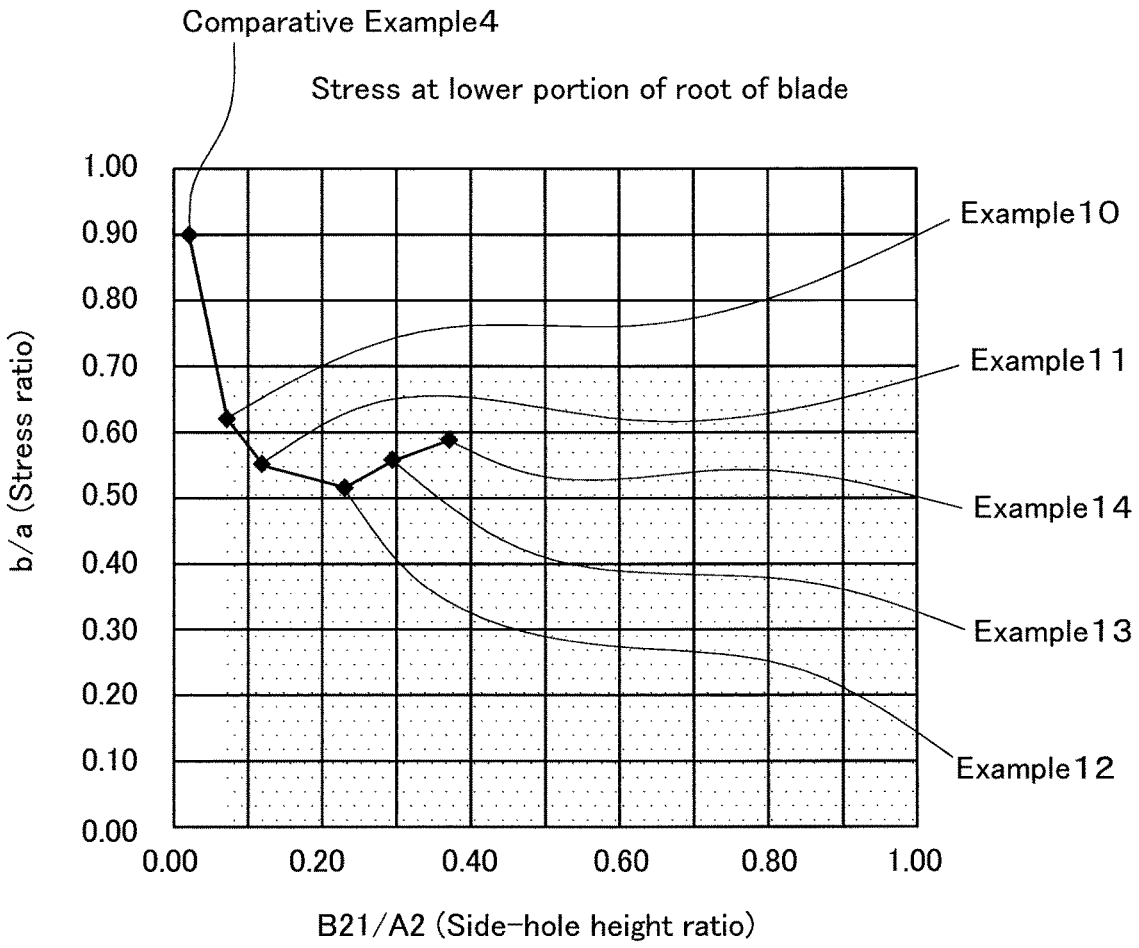
FIG. 10 is a graph showing test results.

FIG. 10 shows the results. Referring to FIG. 10, in Comparative Example 4, as described above, the stress ratio (b/a) was significantly larger than 0.7 at the lower portion of the root of the blade. Accordingly, it is shown that the load that acted on the root of the blade was large, which is not preferable for realizing a longer life of the stirring fan.

On the other hand, in Examples 10 to 14, the stress ratios (b/a) had small values lower than 0.7 at the lower portion of the root of the blade. Accordingly, it is shown that the load that acted on the root of the blade was small, which is preferable for realizing a longer life of the stirring fan. Note that the difference between the stress ratios (b/a) of Comparative Example 4 and Example 10 at the lower portion of the blade was more drastic than that between Example 10 and Example 11. Thus, the critical significance of performing setting such that (B21/A2)≥0.07 is clear.

4. Description of Significance of Performing Setting such that (B3×n3)/A3≥0.1, where Total Length of Outer Circumferential Face of Cylindrical Portion in Circumferential Direction of Cylindrical Portion is Taken as A3, Length of Discharge Hole in Circumferential Direction is Taken as B3, and Number of Discharge Holes is Taken as n3

Production of Examples

Examples 15 to 18 were produced by performing a computer simulation of stirring fans having the same shape as that of the stirring fan 7 shown in FIG. 2 of the foregoing embodiment. Note that the materials used in Examples 15 to 18 were the same as those in Example 1. In Examples 15 to 18, (B3×n3)/A3 was as follows.

Example 15: (B3×n3)/A3=0.15

Examples 16 and 17: (B3×n3)/A3=0.30

Example 18: (B3×n3)/A3=0.50

Examples 15 and 16 had two discharge holes each having an opening area of (A1/12) $mm^2$. Examples 17 and 18 had two discharge holes each having an opening area of (A1/6) $mm^2$.

Experimental Conditions

The experimental conditions in Examples 15 to 18 were the same as those in Examples 1 to 5. In Examples 15 to 18 and Comparative Example 1, the stress ratios (b/a) were shown in a graph.

Calculation Results

Figure 11:
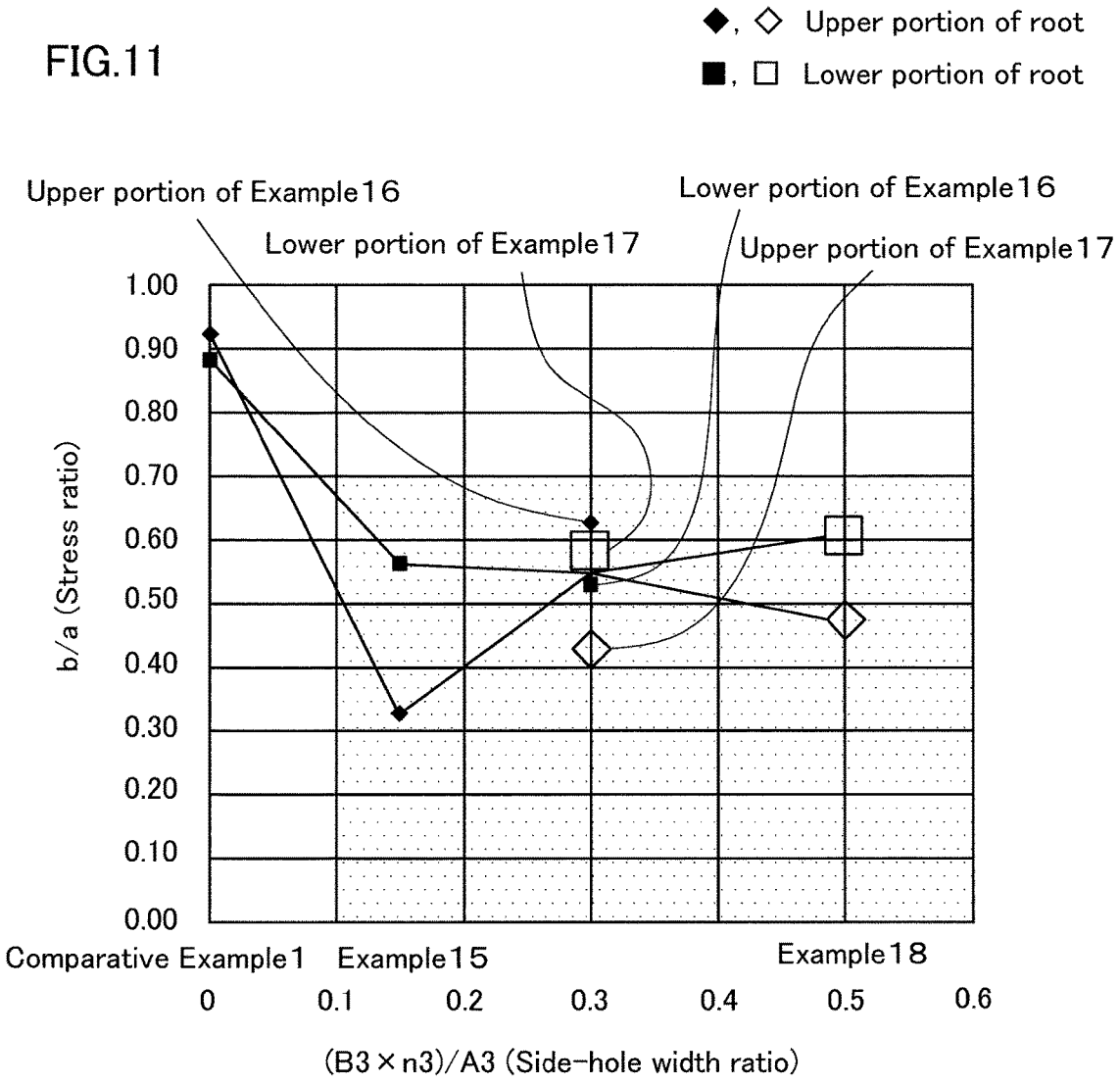
FIG. 11 is a graph showing test results.

FIG. 11 shows the results. Referring to FIG. 11, in Comparative Example 1, the stress ratio (b/a) was significantly larger than 0.7 at both the upper portion and the lower portion of the root of the blade.

On the other hand, in Examples 15 to 18, the stress ratios (b/a) had small values lower than 0.7 at both the upper portion and the lower portion of the root of the blade. Accordingly, it is shown that the load that acted on the root of the blade was small, which is preferable for realizing a longer life of the stirring fan. Note that the difference between the stress ratios (b/a) of Comparative Example 1 and Example 15 at the upper portion of the blade was more drastic than that between Example 15 and Example 16. Thus, the critical significance of performing setting such that (B3×n3)/A3≥0.1 is clear.

The present invention is broadly applicable to stirring fans for heat treatment apparatuses, and heat treatment apparatuses.

What is claimed is:

1. A stirring fan for a heat treatment apparatus, comprising:

a shaft; and a plurality of blades radially extending from the shaft, wherein the shaft includes a blade fixing portion for fixing the blades, the blade fixing portion includes a cylindrical portion extending in a longitudinal direction of the shaft, a hole inside the cylindrical portion is open to one end face of the shaft and a deeper side of the hole is closed, the stirring fan further comprises a discharge portion for discharging gas inside the cylindrical portion to the outside of the blade fixing portion, the discharge portion is open to the outside of the blade fixing portion, at a position away from the one end face of the shaft, the discharge portion includes a discharge hole that is continuous with the hole inside the cylindrical portion and that is open to an outer surface of the stirring fan, the discharge hole is opened to an outer circumferential face of the blade fixing portion at a position between two roots of the two blades adjacent to each other in a circumferential direction of the shaft, and the deeper side of the hole is closed such that the gas introduced into the hole from opening of the one end face of the shaft is discharged to outside of the cylindrical portion at a position between the two roots of the two blades adjacent to each other via the discharge hole.

2. The stirring fan for a heat treatment apparatus according to claim 1, wherein the discharge hole is open to an outer surface of the blade fixing portion.

3. The stirring fan for a heat treatment apparatus according to claim 1, wherein the discharge hole is disposed at a center portion of the blade fixing portion in the longitudinal direction of the shaft.

4. The stirring fan for a heat treatment apparatus according to claim 1, wherein when viewed in a central axis direction of the discharge hole, the discharge hole has circular-arc corners.

5. The stirring fan for a heat treatment apparatus according to claim 1, wherein an inner circumferential face of the cylindrical portion includes a plurality of cylindrical faces that are arranged along the longitudinal direction, an inner diameter of a cylindrical face disposed on a deeper side of the cylindrical portion being smaller than an inner diameter of a cylindrical face disposed on the side of the one end face of the shaft, and the discharge hole is formed across at least two of the cylindrical faces.

6. The stirring fan for a heat treatment apparatus according to claim 1, wherein one discharge hole is provided between two of the blades adjacent to each other in a circumferential direction of the shaft, and is disposed at a center portion between the two blades in the circumferential direction.

7. The stirring fan for a heat treatment apparatus according to claim 1, wherein a plurality of the discharge holes are provided between two of the blades adjacent to each other in a circumferential direction of the shaft.

8. The stirring fan for a heat treatment apparatus according to claim 7, wherein the plurality of the discharge holes are provided along the longitudinal direction between the two blades.

9. The stirring fan for a heat treatment apparatus according to claim 8, wherein among the plurality of discharge holes, an opening area of a discharge hole that is closer to the one end face of the cylindrical portion than the others are is set to be smaller than an opening area of a discharge hole that is closer to a base end of the cylindrical portion than the others are.

10. The stirring fan for a heat treatment apparatus according to claim 7, wherein the plurality of discharge holes are provided at an equal pitch along the circumferential direction of the shaft, between the two blades.

11. The stirring fan for a heat treatment apparatus according to claim 1, wherein the discharge hole is formed in the shape of an elongated hole that is elongated in the longitudinal direction.

12. The stirring fan for a heat treatment apparatus according to claim 1, wherein the stirring fan is made of heat-resistant steel, and a shape of the discharge hole is set such that $b/a \leq 0.7$ when the shaft and the blades of the stirring fan are rotationally driven in an atmosphere at 1000° C., where a tensile strength of the shaft and the blades is taken as "a", and stress at a point with the highest stress in the shaft and the blades is taken as "b".

13. The stirring fan for a heat treatment apparatus according to claim 12, wherein $(B1 \times n1)/A1 \geq 0.1$, where an opening area of an inner circumferential face at one end in the longitudinal direction of the shaft is taken as A1, an opening area of the discharge hole in a cross-section orthogonal to an axial direction of the discharge hole is taken as B1, and the number of the discharge holes is taken as n1.

14. The stirring fan for a heat treatment apparatus according to claim 12, wherein $B21/A2 \geq 0.07$, where a total length of the blade fixing portion in the longitudinal direction is taken as A2, and a distance from the one end face of the cylindrical portion to the discharge hole is taken as B21.

15. The stirring fan for a heat treatment apparatus according to claim 12, wherein $B22/A2 \leq 0.5$, where a total length of the blade fixing portion in the longitudinal direction is taken as A2, and a distance from another end opposite from the one end face, of the blade fixing portion, to the discharge hole is taken as B22.

16. The stirring fan for a heat treatment apparatus according to claim 12, wherein $B21/A2 \geq 0.07$, where a total length of the blade fixing portion in the longitudinal direction is taken as A2, and a distance from the one end face of the cylindrical portion to the discharge hole is taken as B21, and $B22/A2 \leq 0.5$, where a distance from another end opposite from the one end face, of the blade fixing portion, to the discharge hole is taken as B22.

17. The stirring fan for a heat treatment apparatus according to claim 12, wherein $(B3 \times n3)/A3 \geq 0.1$, where a total length of an outer circumferential face of the cylindrical portion in a circumferential direction of the cylindrical portion is taken as A3, a length of the discharge hole in the circumferential direction is taken as B3, and the number of the discharge holes is taken as n3.

18. A heat treatment apparatus, comprising:

a treatment chamber for performing heat treatment on a treatment target article; and the stirring fan according to claim 1 disposed in the treatment chamber.

19. The stirring fan for a heat treatment apparatus according to claim 1, wherein an end portion of the blade includes a portion extending in a direction away from the shaft in the length direction of the shaft and extending from the blade fixing portion in a radial direction of the shaft from a position flush with one end face of the shaft.

* * * * *